US009946196B2

(12) United States Patent
Nishiyama et al.

(10) Patent No.: US 9,946,196 B2
(45) Date of Patent: Apr. 17, 2018

(54) TONER CARTRIDGE ATTACHABLE TO DEVELOPING UNIT AND HAVING TONER DISCHARGE OPENING OPENED IN RESPONSE TO THE ATTACHMENT

(71) Applicant: BROTHER KOGYO KABUSHIKI KAISHA, Nagoya-shi, Aichi-ken (JP)

(72) Inventors: Hideshi Nishiyama, Owariasahi (JP); Takashi Shimizu, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/469,341

(22) Filed: Mar. 24, 2017

(65) Prior Publication Data

US 2017/0285528 A1 Oct. 5, 2017

(30) Foreign Application Priority Data

Mar. 31, 2016 (JP) ..... 2016-073401

(51) Int. Cl.
*G03G 15/08* (2006.01)

(52) U.S. Cl.
CPC ..... *G03G 15/0886* (2013.01); *G03G 15/0891* (2013.01)

(58) Field of Classification Search
CPC ..... G03G 15/0839; G03G 15/0886; G03G 15/0889; G03G 15/0891
See application file for complete search history.

(56) References Cited

U.S. PATENT DOCUMENTS

| | | | | |
|---|---|---|---|---|
| 6,766,133 | B1 | 7/2004 | Ban et al. | |
| 2010/0247156 | A1* | 9/2010 | Awano | G03G 15/0875 399/258 |
| 2012/0087694 | A1* | 4/2012 | Itabashi | G03G 15/0879 399/106 |

FOREIGN PATENT DOCUMENTS

| | | | |
|---|---|---|---|
| JP | 7-181793 | A | 7/1995 |
| JP | 2000-275945 | A | 10/2000 |
| JP | 2001-083792 | A | 3/2001 |
| JP | 2011-257488 | A | 12/2011 |

* cited by examiner

*Primary Examiner* — Hoang Ngo
(74) *Attorney, Agent, or Firm* — Merchant & Gould P.C.

(57) ABSTRACT

A toner cartridge includes a casing, a toner conveyance unit, a cover, and a first protrusion. The casing includes a first toner-accommodating section having a first internal space for accommodating toner. The first toner-accommodating section has a first opening. The toner conveyance unit is rotatable and configured to convey toner from the first internal space to the first opening. The cover covers the first opening and has a second opening for allowing toner to be discharged therethrough. The cover has a circumferential surface at which a plurality of gear teeth is provided. The gear teeth are configured to move a developing shutter provided at a developing unit for opening or closing an opening of the developing unit. The first protrusion is configured to release the developing shutter from a locking member of the developing unit for locking the developing shutter.

15 Claims, 23 Drawing Sheets

TONER CARTRIDGE ATTACHABLE TO DEVELOPING UNIT AND HAVING TONER DISCHARGE OPENING OPENED IN RESPONSE TO THE ATTACHMENT

CROSS REFERENCE TO RELATED APPLICATION

This application claims priority from Japanese Patent Application No. 2016-073401 filed Mar. 31, 2016. The entire content of the priority application is incorporated herein by reference.

TECHNICAL FIELD

The present disclosure relates to a toner cartridge.

BACKGROUND

A toner cartridge detachably attachable to a developing unit is known in the art. The toner cartridge accommodates toner therein.

SUMMARY

It is an object of the disclosure to provide a toner cartridge capable of moving a locking member of a developing unit from a locking position to a released position according to the user's operation of mounting the toner cartridge on the developing unit In order to attain the above and other objects, the disclosure provides a toner cartridge including: a casing, a toner conveyance unit, a cover, and a first protrusion. The casing extends in a first direction and includes a first toner-accommodating section having a first internal space configured to accommodating toner therein. The first toner-accommodating section includes one end portion and another end portion in the first direction. The first toner-accommodating section has a first opening positioned at the one end portion. The first opening allows toner in the first internal space to be discharged therethrough. The toner conveyance unit extends in the first direction and rotatable in a rotating direction about a first axis extending in the first direction. The toner conveyance unit is configured to convey toner from the first internal space to the first opening. The cover is positioned at the one end portion of the first toner-accommodating section and covers the first opening. The cover has a second opening allowing toner in the first internal space to be discharged therethrough. The cover includes a plurality of gear teeth positioned at a circumferential surface of the cover. The plurality of gear teeth is arrayed in the rotating direction. The plurality of gear teeth is positioned at one side of the second opening in the first direction and is configured to move a developing shutter of a developing unit for opening or closing an opening of the developing unit. The first protrusion is positioned opposite to the second opening with respect to the plurality of gear teeth in the first direction. The first protrusion is configured to release the developing shutter from a locking member of the developing unit. The locking member is configured to lock the developing shutter.

BRIEF DESCRIPTION OF THE DRAWINGS

The particular features and advantages of the disclosure will become apparent from the following description taken in connection with the accompanying drawings, in which.

DETAILED DESCRIPTION

1. Outline of Toner Cartridge 1

An outline of a toner cartridge 1 will be described.

Figure 1:
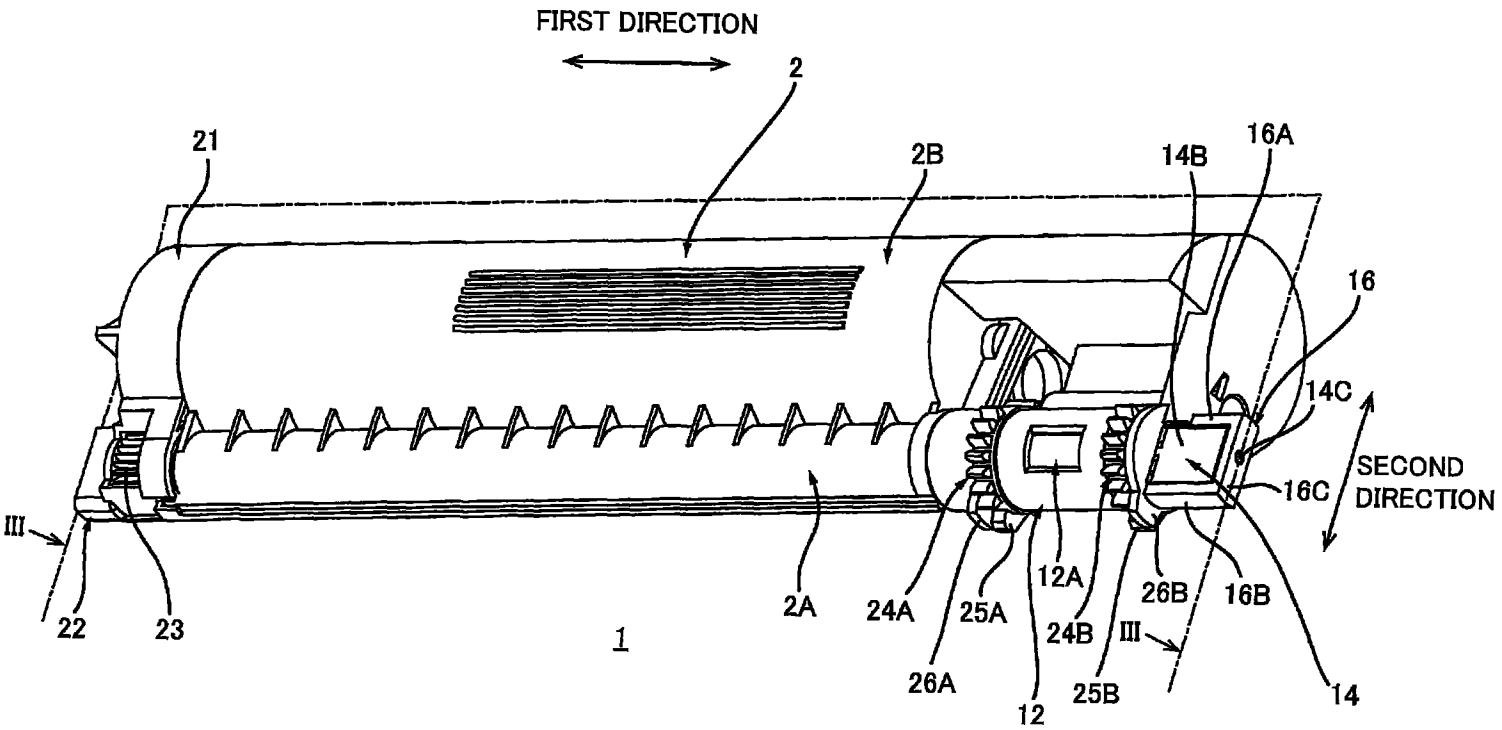
FIG. 1 is a perspective view of a toner cartridge 1 according to one embodiment.
Figure 10:
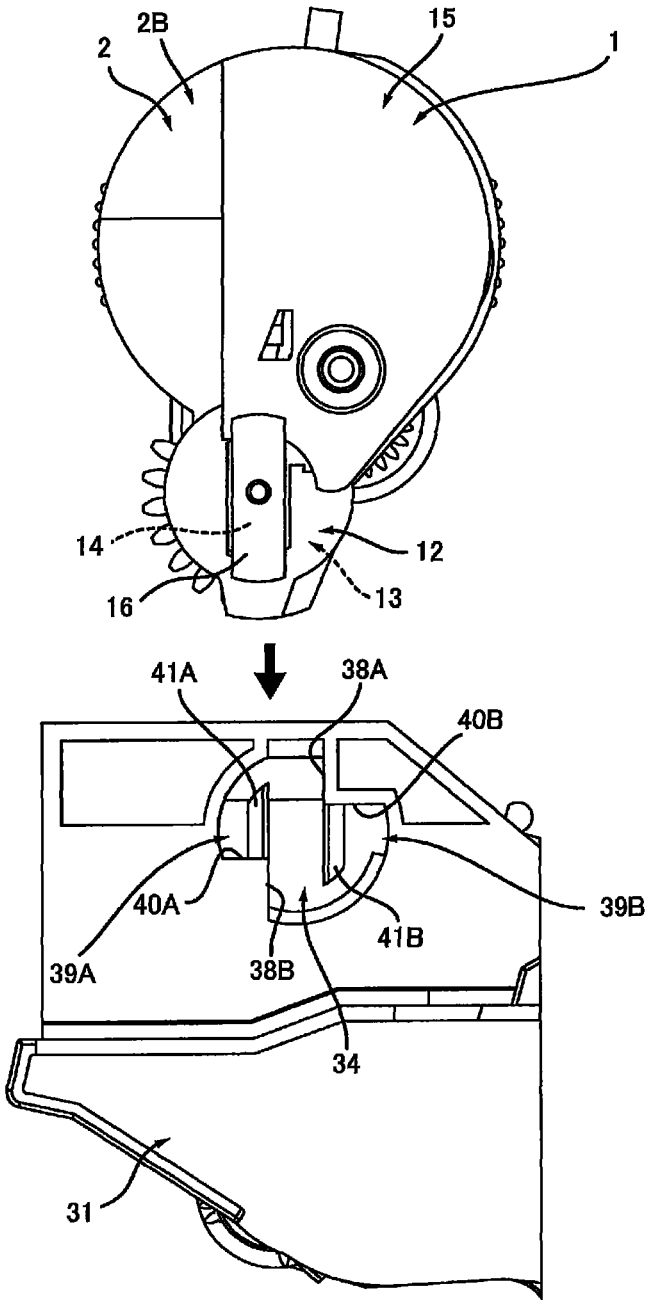
FIG. 10 is a view for description of attachment of the toner cartridge 1 to the developing unit 31, and illustrating a state prior to attachment of the toner cartridge 1 to the developing unit 31.
Figure 11:
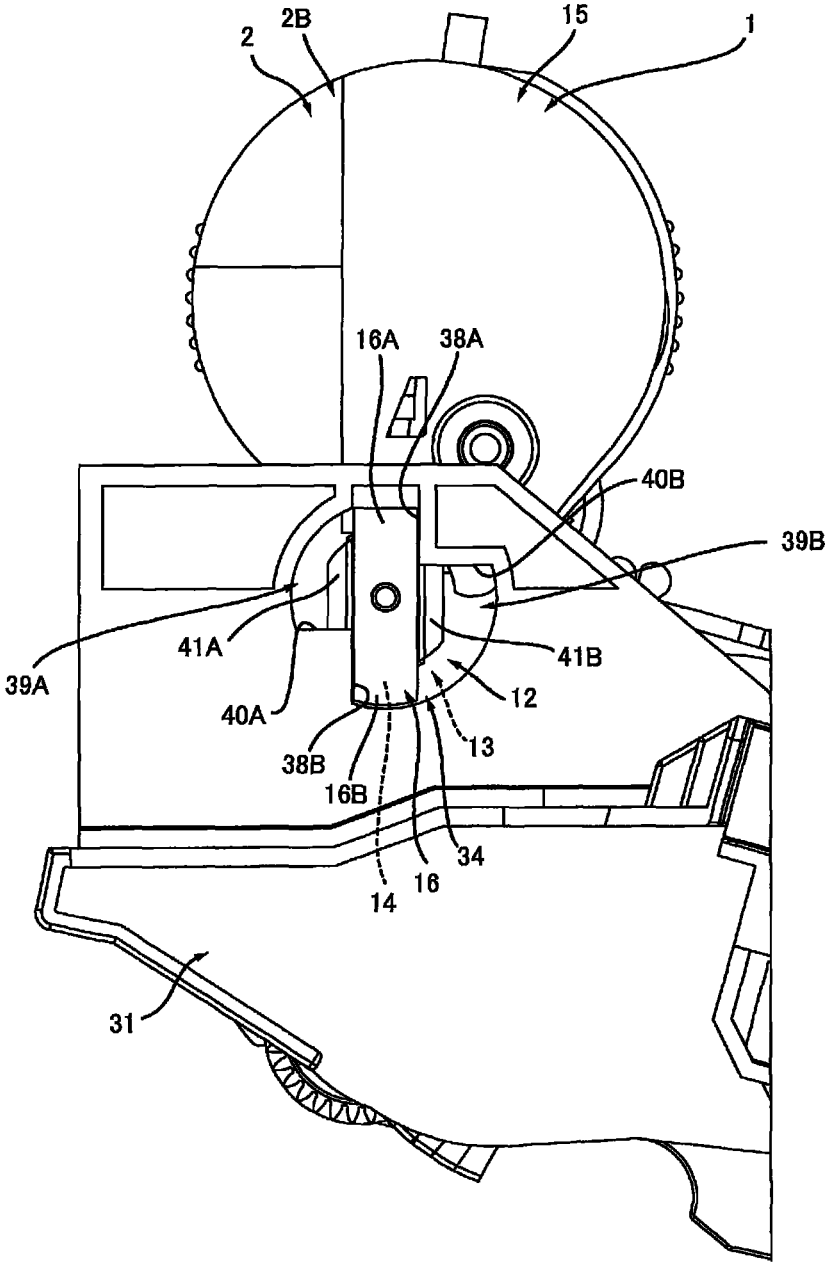
FIG. 11 is a view for description of attachment of the toner cartridge 1 to the developing unit 31, and illustrating a state after attachment of the toner cartridge 1 to the developing unit 31 and illustrating a first position of a casing 2.

The toner cartridge 1 illustrated in FIG. 1 is a cartridge accommodating toner therein. As will be described in detail later, the toner cartridge 1 is configured to be attached to a developing unit 31 described later as illustrated in FIGS. 10 and 11. Then, the toner cartridge 1 pivots relative to the developing unit 31 from a state illustrated in FIG. 11 to a state illustrated in FIG. 21, whereby the toner cartridge 1 is attached to the developing unit 31. The toner cartridge 1 can supply toner to the developing unit 31 in a state where the toner cartridge 1 is attached to the developing unit 31. Incidentally, "the toner cartridge 1 pivots" denotes that a pivotally movement of the toner cartridge 1 about an axis passing through one end portion of the toner cartridge 1. Specifically, the axis passing through the toner cartridge 1 is a first axis A1 described later.

Figure 2:
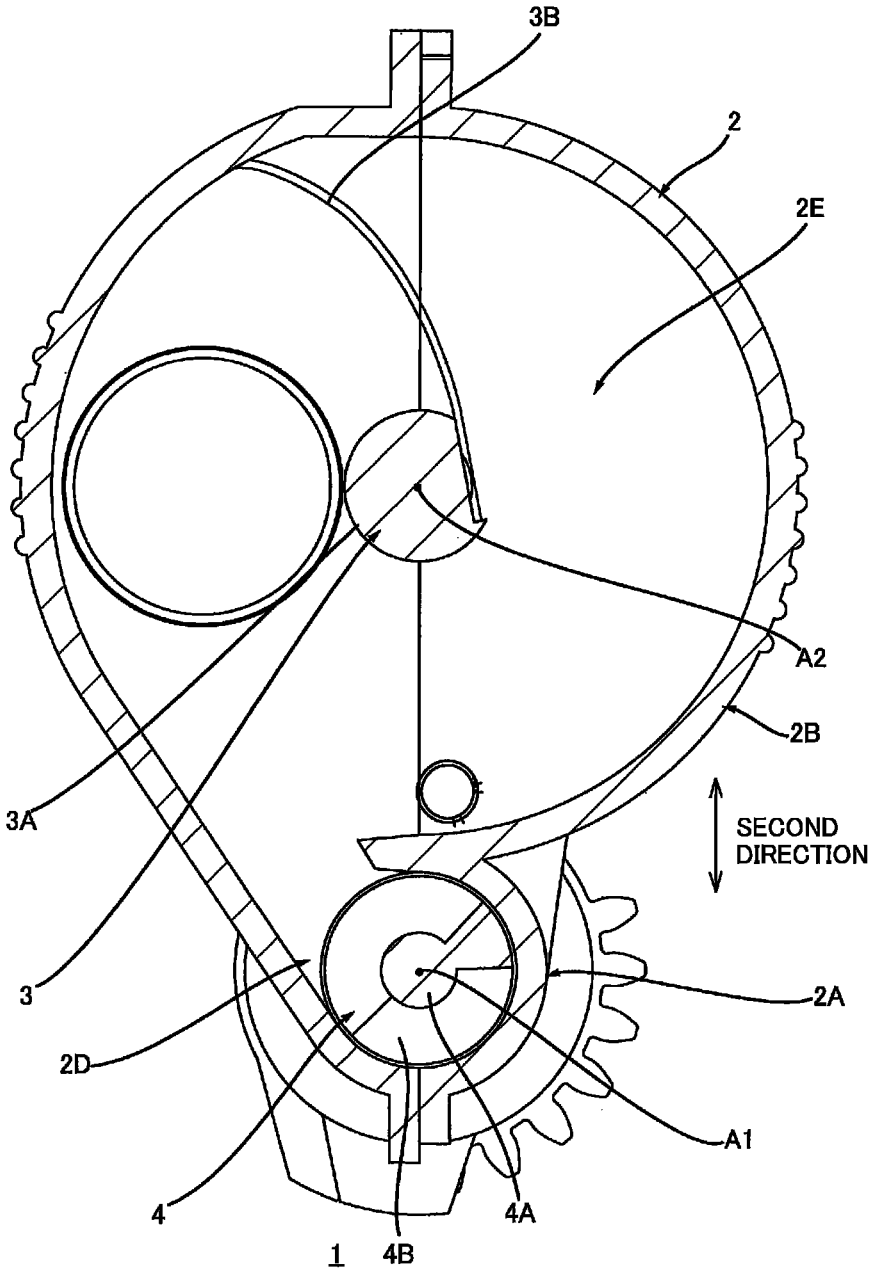
FIG. 2 is a central cross-sectional view of the toner cartridge 1.
Figure 3:
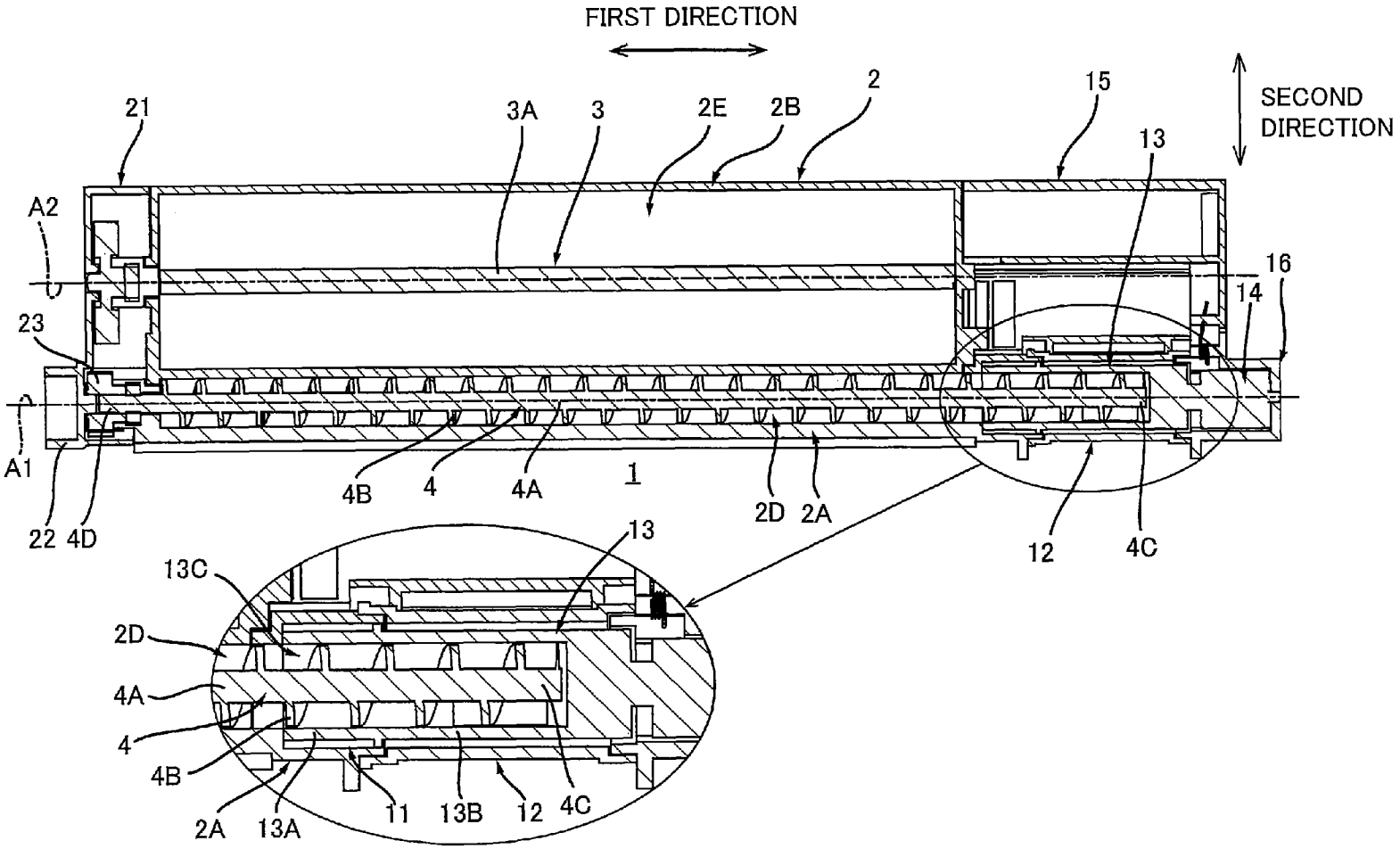
FIG. 3 is a cross-sectional view taken along a line III-III of FIG. 1.

As illustrated in FIGS. 1 through 3, the toner cartridge 1 includes a casing 2, an agitator 3, and a toner conveyance unit 4.

1.1 Casing 2

The casing 2 extends in a first direction. The casing 2 includes a first toner-accommodating section 2A and a second toner-accommodating section 2B. The second toner-accommodating section 2B is positioned at one side of the first toner-accommodating section 2A in a second direction. The second direction is defined as a direction in which an imaginary line connecting the first axis A1 described later to a second axis A2 described later extends. The first toner-accommodating section 2A has a hollow cylindrical shape extending in the first direction. The first toner-accommodating section 2A has a first internal space 2D. The first internal space 2D is configured to accommodate toner therein. The second toner-accommodating section 2B has a hollow cylindrical shape extending in the first direction. The second toner-accommodating section 2B has an outer diameter greater than that of the first toner-accommodating section 2A. The second toner-accommodating section 2B has a second internal space 2E. The first internal space 2D and the second internal space 2E are aligned in the second direction. The second internal space 2E is in communication with the first internal space 2D. The second internal space 2E has an internal capacity greater than an internal capacity of the first internal space 2D. The second internal space 2E has an inner diameter greater than an inner diameter of the first internal space 2D. Incidentally, the first toner-accommodating section 2A and the second tone accommodating section 2B may be integrally configured. Alternatively, the first toner-accommodating section 2A and the second toner-accommodating section 2B may be configured as separate components and assembled together. In a state where the toner cartridge 1 is attached to the developing unit 31 described later, the casing 2 is pivotally movable between a first position (see FIG. 11) and a second position (see FIG. 21) relative to the developing unit 31 described later.

1.2 Toner Conveyance Unit 4

The toner conveyance unit 4 is positioned inside the first internal space 2D. As will be described in detail later, the toner conveyance unit 4 is configured to convey toner in the first internal space 2D to a second opening 12A described later. The toner conveyance unit 4 extends in the first direction. The toner conveyance unit 4 is rotatable about the first axis A1 extending in the first direction. An auger screw is an example of the toner conveyance unit 4. The toner conveyance unit 4 includes a shaft 4A and a spiral portion 4B. The shaft 4A extends along the first axis A1. The spiral portion 49 protrudes from the shaft 4A in a radial direction of the first toner-accommodating section 2A. The spiral portion 4B has a spiral shape whose axis extends in the first direction. In other words, the toner conveyance unit 4 has a spiral shape. Further, the toner conveyance unit 4 is not limited to an auger screw. For example, the toner conveyance unit 4 may include a shaft and blades extending from the shaft.

1.3 Agitator 3

The agitator 3 is positioned inside the second internal space 2E. The agitator 3 is configured to agitate toner in the second internal space 2E and convey toner from the second internal space 2E to the first internal space 2D. The agitator 3 is rotatable about the second axis A2 extending in the first direction. The agitator 3 includes an agitator shaft 3A and a blade 3B. The agitator shaft 3A extends along the second axis A2. The blade 3B extends from the agitator shaft 3A in a radial direction of the second toner-accommodating section 2B. The blade 39 is rotatable with the agitator shaft 3A. The blade 3B includes a base end portion connected to the agitator shaft 3A and a free end portion separated from the agitator shaft 3A. The free end portion of the blade 3B contacts an inner surface of the second toner-accommodating section 2B. By contacting the inner surface of the second toner-accommodating section 2B, the free end portion of the blade 3B is curved toward an upstream side in a rotating direction of the agitator 3. As the blade 39 is rotated, the agitator 3 agitates toner in the second internal space 2E and conveys toner from the second internal space 2E to the first internal space 2D.

2. Details of Toner Cartridge 1

Details of the toner cartridge 1 will be described with reference to FIGS. 3 through 7.

2.1 First Toner-Accommodating Section 2A

Figure 4:
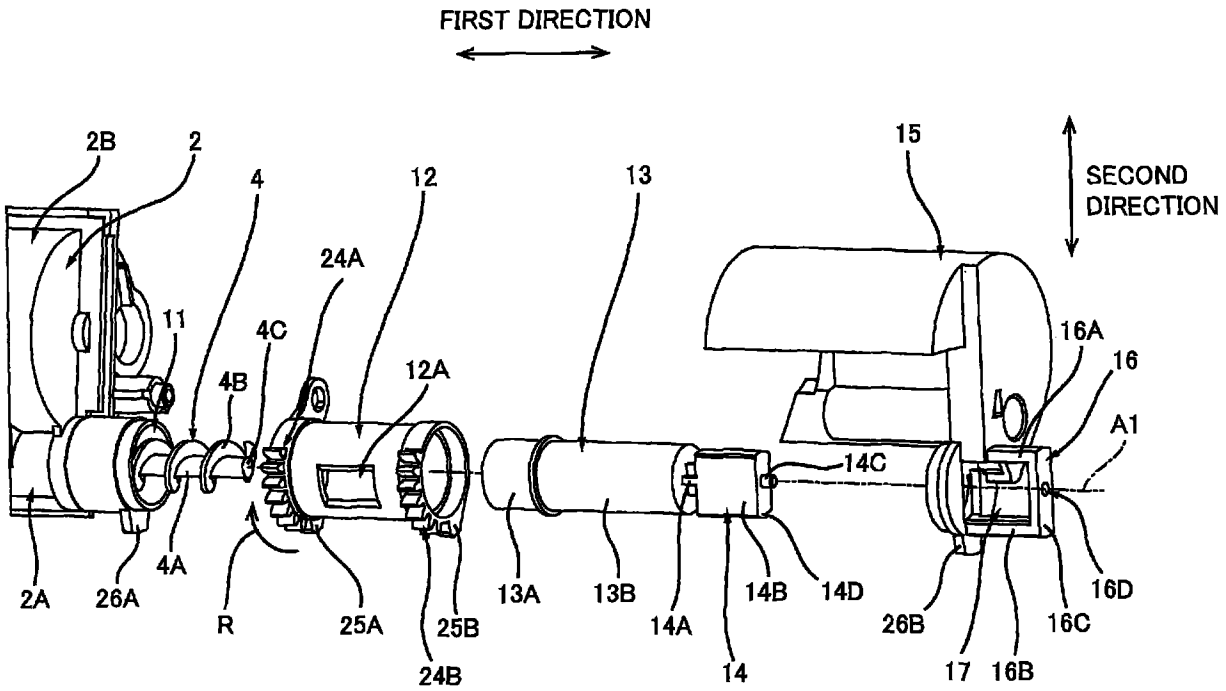
FIG. 4 is an exploded perspective view illustrating one end portion of the toner cartridge 1.

As illustrated in FIGS. 3 and 4, the first toner-accommodating section 2A has a first opening 11. The first opening 11 is positioned at one end portion of the first toner-accommodating section 2A in the first direction. The one end portion of the first toner-accommodating section 2A in the first direction is positioned outward of one end portion of the second toner-accommodating section 2B in the first direction. That is, a length of the first toner-accommodating section 2A in the first direction is greater than that of the second toner-accommodating section 2B in the first direction. Consequently, a length of the second internal space 2E in the first direction is smaller than that of the first internal space 2D in the first direction. The one end portion of the first toner-accommodating section 2A has a hollow cylindrical shape. The first opening 11 penetrates the one end portion of the first toner-accommodating section 2A in the first direction. The first opening 11 is in communication with the first internal space 2D, thereby allowing toner n the first internal space 2D to be discharged through the first opening 11. The toner conveyance unit 4 is inserted through the first opening 11. The toner conveyance unit 4 has one end portion 4C in the first direction and another end portion 4D separated from the one end portion 4C in the first direction. The one end portion 4C of the toner conveyance unit 4 protrudes out from the first opening 11 in the first direction. Thus, the toner conveyance unit 4 can convey toner from the first internal space 2D to the first opening 11. A gear 23 is mounted to the other end portion 4D of the toner conveyance unit 4. The gear 23 is rotatable with the toner conveyance unit 4.

2.2 Cover 12

As illustrated in FIGS. 3 and 4, the toner cartridge 1 further includes a cover 12. The cover 12 is positioned at the one end portion of the first toner-accommodating section 2A. More specifically, the cover 12 is provided at the one end portion of the first toner-accommodating section 2A. With this configuration, the cover 12 is movable together with the casing 2. The cover 12 is configured to cover the first opening 11. The cover 12 is also configured to cover the one end portion 4C of the toner conveyance unit 4 in the first direction. More specifically, the cover 12 is configured to cover a circumferential surface of the one end portion 4C of the toner conveyance unit 4. The cover 12 extends along the circumferential surface of the one end portion 4C of the toner conveyance unit 4. That is, the cover 12 has a hollow cylindrical shape extending in the first direction. The cover 12 has the second opening 12A.

Figure 5A:
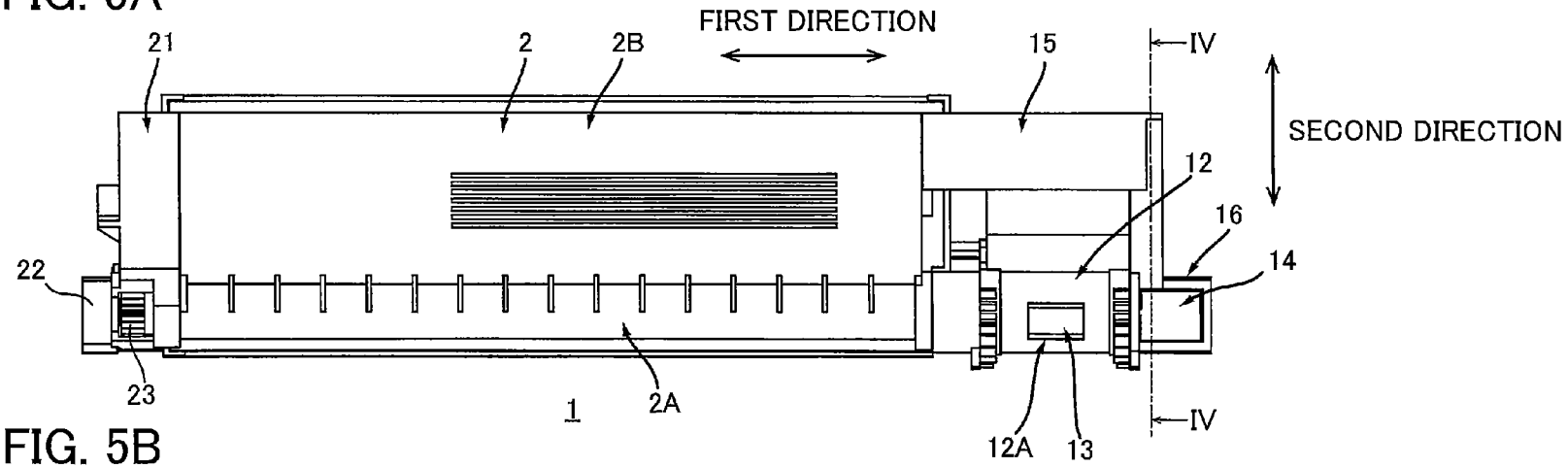
FIG. 5A is a view of the toner cartridge 1 as viewed in a direction intersecting with a second direction, and illustrating a closed position of a shutter 13 in the toner cartridge 1 according to the embodiment.
Figure 5B:
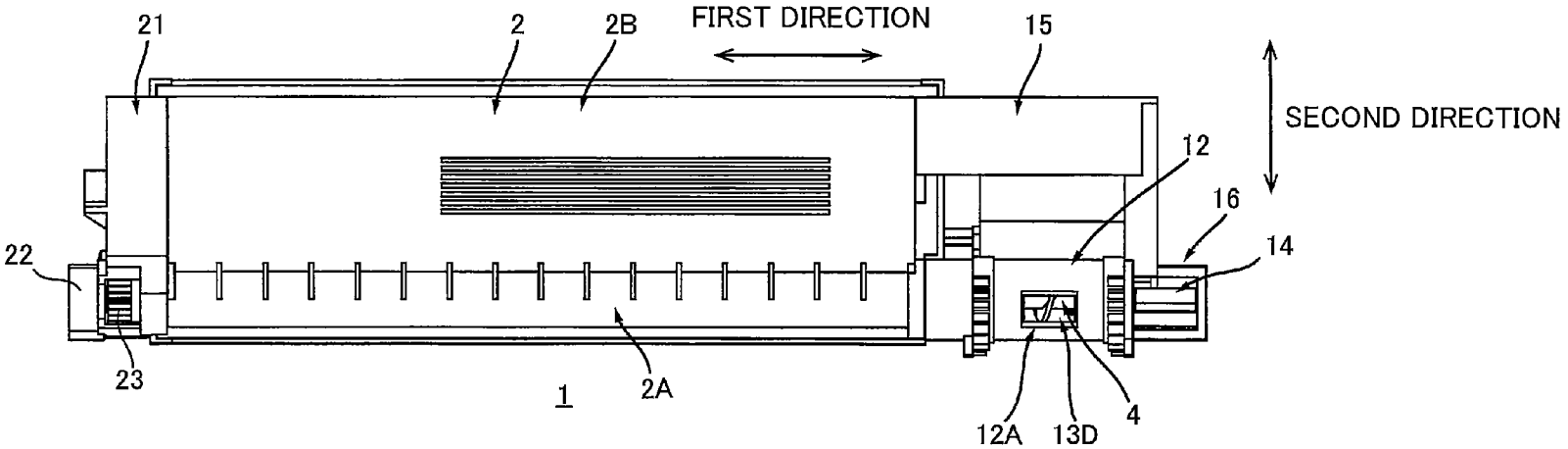
FIG. 5B is a view of the toner cartridge 1 as viewed in the direction intersecting with the second direction, and illustrating an open position of the shutter 13.

As illustrated in FIG. 4, the second opening 12A is positioned at a position separated from the first toner-accommodating section 2A in the first direction. More specifically, the second opening 12A is positioned at a position separated from the first opening 11 in the first direction. The second opening 12A penetrates a circumferential surface of the cover 12, thereby allowing toner to be discharged through the second opening 12A. As illustrated in FIG. 5B, the toner conveyance unit 4 extends to the second opening 12A in the first direction. With this configuration, the toner conveyance unit 4 can convey toner from the first internal space 2D to the second opening 12A through the cover 12

2.3 Shutter 13

As illustrated in FIGS. 3 and 4, the toner cartridge 1 further includes a shutter 13. The shutter 13 is positioned at the one end portion of the first toner-accommodating section 2A. More specifically, the shutter 13 is inserted into the cover 12 and the one end portion of the first toner-accommodating section 2A. Thus, the shutter 13 is mounted to the one end portion of the first toner-accommodating section 2A. The shutter 13 is rotatable relative to the casing 2 and the cover 12 between a closed position (see FIG. 5A) for closing the second opening 12A and an open position (see FIG. 5B) for opening the second opening 12A. When the casing 2 is positioned at the first position, the shutter 13 is positioned at the closed position relative to the casing 2 and the cover 12. When the casing 2 is positioned at the second position, the shutter 13 is positioned at the open position relative to the casing 2 and the cover 12.

The shutter 13 extends in the first direction. The shutter 13 includes one end portion and another end portion. The other end portion is positioned farther than the one end portion from the first toner-accommodating section 2A in the first direction. The shutter 13 includes an insertion part 13A and a cover part 13B. The insertion part 13A is positioned at the one end portion of the shutter 13 and is inserted into the first opening 11. The insertion part 13A has an opening 13C. The opening 13C penetrates the insertion part 13A in the first direction, thereby allowing toner in the first internal space 2D to be introduced into an internal space of the shutter 13. The cover part 13B and the insertion part 13A are aligned in the first direction. The cover part 13B is positioned between the insertion part 13A and a protrusion 14 described later in the first direction. The cover part 13B protrudes outward of the first opening 11 in the first direction. The cover part 13B covers the circumferential surface of the one end portion 4C of the toner conveyance unit 4. The cover part 13B extends along the circumferential surface of the one end portion 4C of the toner conveyance unit 4. The cover part 13B also extends along an inner surface of the cover 12. In other words, the cover 12 extends along a circumferential surface of the cover part 13B and covers the circumferential surface of the cover part 13B. That is, the cover part 13B has a hollow cylindrical shape extending in the first direction. The cover part 13B has a third opening 13D (see FIG. 5B). That is, the shutter 13 has the third opening 13D. The third opening 13D penetrates the circumferential surface of the cover part 13B. A seal S (see FIG. 13) is provided around the third opening 13D. The seal S is positioned between the inner surface of the cover 12 and the circumferential surface of the cover part 13B, thereby preventing toner from entering a space between the inner surface of the cover 12 and the circumferential surface of the cover part 13B. The third opening 13D allows toner in the internal space of the shutter 13 to be discharged. In the closed position of the shutter 13, the second opening 12A of the cover 12 is closed by the shutter 13 as illustrated in FIG. 5A. In other words, the third opening 13D of the shutter 13 is closed by the cover 12. In the open position of the shutter 13, at least a portion of the opening 13D is in alignment with at least a portion of the second opening 12D of the cover 12 as illustrated in FIG. 5B. Accordingly, in a case where the casing 2 is positioned at the first position, the shutter 13 is positioned at the closed position relative to the casing 2, so the second opening 12A is closed by the shutter 13 and the third opening 13D is closed by the cover 12. In a case where the casing 2 is positioned at the second position, the shutter 13 is positioned at the open position relative to the casing 2, and at least the portion of the third opening 13D overlaps at least the portion of the second opening 12A. With this configuration, at least the portion of the third opening 13D allows toner in the internal space of the shutter 13 to be discharged through the second opening 12A when the casing 2 is positioned at the second position. The second opening 12A allows toner in the first internal space 2D to be discharged through the first opening 11, the internal space of the shutter 13, and the third opening 13D.

As illustrated in FIG. 4, the shutter 13 includes the protrusion 14. The protrusion 14 is positioned farther than the cover 12 from the other end portion of the first toner-accommodating section 2A in the first direction. The protrusion 14 is positioned opposite to the insertion part 13A with respect to the cover part 13B in the first direction. The protrusion 14 is subjected to positioning relative to the developing unit 31 (see FIG. 7) described later when the toner cartridge 1 is attached to the developing unit 31. The protrusion 14 extends in the first direction. The protrusion 14 extends from the other end portion of the shutter 13. In other words, the protrusion 14 extends from the cover part 13B. Accordingly, the protrusion 14 is pivotally movable together with the shutter 13 relative to the casing 2 and the cover 12. The protrusion 14 has a base end portion and a distal end portion in the first direction. The base end portion is connected to the cover part 13B. The distal end portion is positioned opposite to the cover part 13B with respect to the base end portion in the first direction. The protrusion 14 includes a shaft part 14A, a flat plate part 14B, and a boss 14C. The shaft part 14A is positioned at the base end portion of the protrusion 14. The shaft part 14A extends from the cover part 13B in the first direction and is connected to the flat plate part 14B. The flat plate part 14B is positioned opposite to the cover part 13B with respect to the shaft part 14A in the first direction. The flat plate part 14B extends in the second direction in a case where the shutter 13 is at the closed position relative to the casing 2. A length of the flat plate part 14B in the second direction is greater than a length of the shaft part 14A in the second direction. The boss 14C is positioned at the distal end portion of the protrusion 14. The boss 14C is positioned opposite to the shaft part 14A with respect to the flat plate part 14B in the first direction. The boss 14C extends from the flat plate part 14B in the first direction. The boss 14 extends along the first axis A1. The boss 14C has a cylindrical shape.

2.4 Second Cover 15

As illustrated in FIG. 4, the toner cartridge 1 includes a second cover 15. The second cover 15 extends in the first direction. The second cover 15 has one end portion and another end portion. The other end portion is positioned farther than the one end portion from the casing 2 in the first direction. The one end portion of the second cover 15 is attached to the second toner-accommodating section 2B. With this configuration, the second cover 15 is movable together with the casing 2 and the cover 12 relative to the shutter 13. The second cover 15 includes a cover part 16.

The cover part 16 is positioned at the other end portion of the second cover 15. The cover part 16 protrudes from the other end portion of the second cover 15 in the first direction. The cover part 16 extends in the second direction. The cover part 16 has a fourth opening 17. The fourth opening 17 penetrates the cover part 16 in a direction intersecting with the first direction and the second direction. The cover part 16 includes a first frame 16A, a second frame 16B, and a third frame 16C. The first frame 16A is positioned away from the second frame 16B in the second direction. The fourth opening 17 is positioned at a position between the first frame 16A and the second frame 16B. The third frame 16C is positioned opposite to the casing 2 with respect to the fourth opening 17 in the first direction. The third frame 16C extends in the second direction. The third frame 16C is connected to the first frame 16A and the second frame 16B. The third frame 16C has a through hole 16D. The through hole 16D penetrates the third frame 16C in the first direction.

As illustrated in FIGS. 1 and 3, the protrusion 14 is inserted into the cover part 16. Then, the flat plate part 149 of the protrusion 14 is positioned between the first frame 16A and the second frame 16B. The flat plate part 14B of the protrusion 14 is exposed through the fourth opening 17. With this configuration, the first frame 16A and the second frame 16B cover the edges of the flat plate part 14B in a case where the shutter 13 is at the closed position. The third frame 16C faces the flat plate part 14B in the first direction. Thus, the third frame 16C covers at least a portion of the distal end portion of the protrusion 14 in the first direction. In other words, the second cover 15 covers at least the portion of the distal end portion of the protrusion 14 in the first direction. Further, the boss 14C of the protrusion 14 is inserted into the through hole 16D. In this way, the second cover 15 rotatably supports the distal end portion of the protrusion 14.

Figure 6:
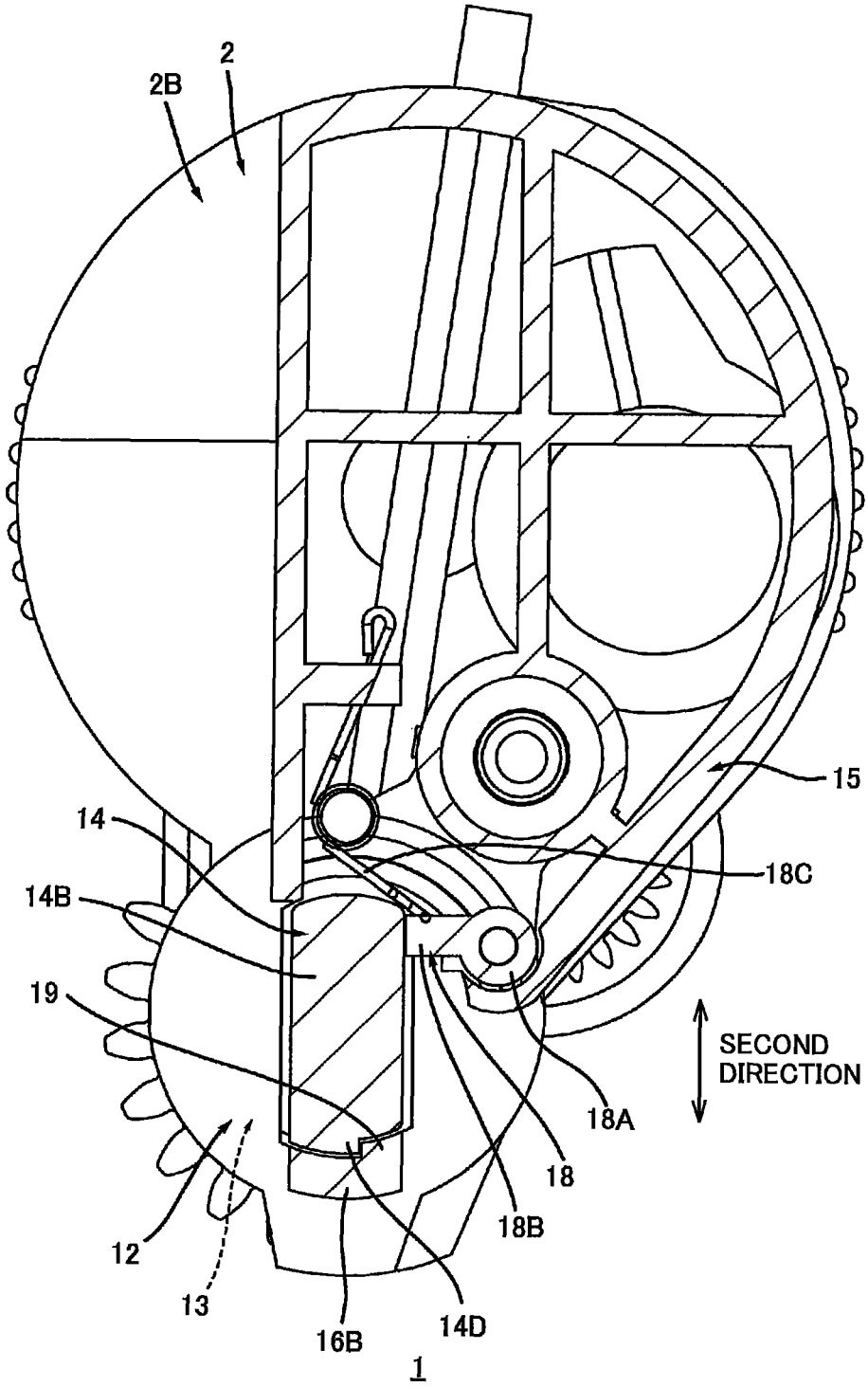
FIG. 6 is a cross-sectional view taken along a line IV-IV of FIG. 5A.

As illustrated in FIG. 6, the second cover 15 includes a locking member 18 and a stopper 19.

Figure 12:
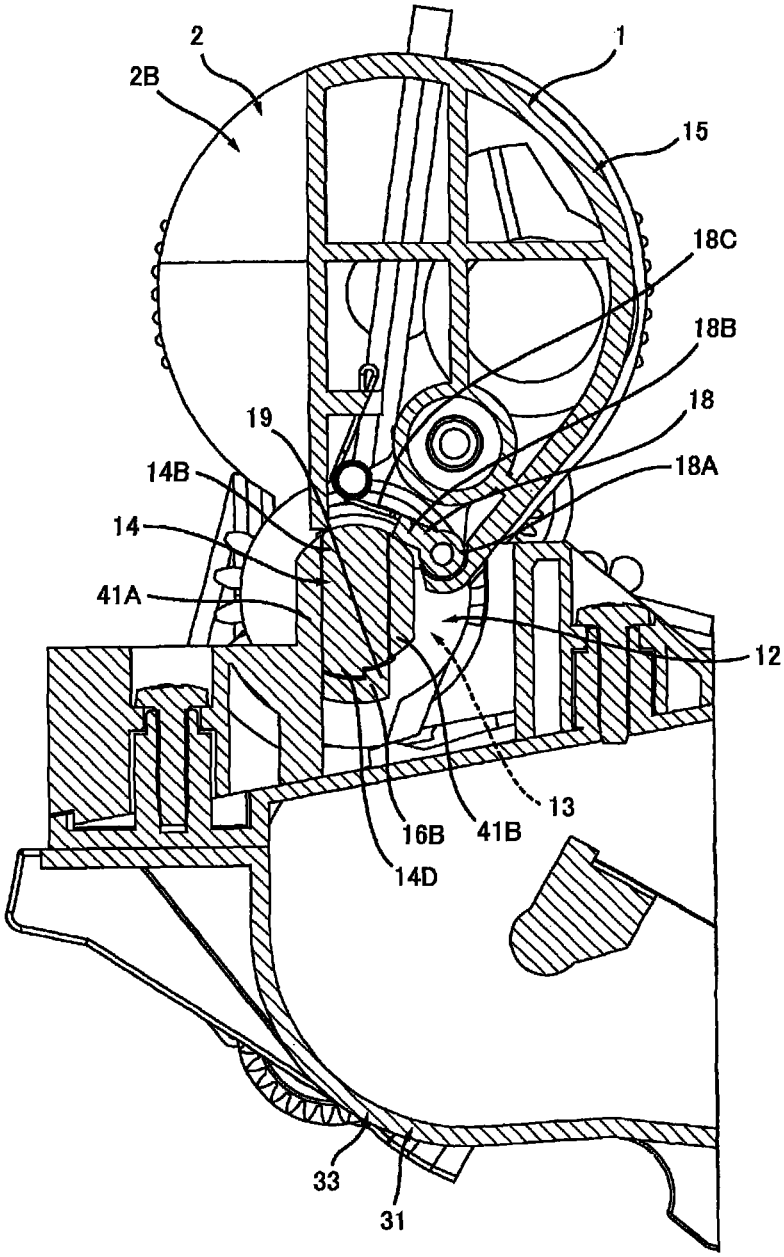
FIG. 12 is a cross-sectional view of the developing unit 31 and the toner cartridge 1 illustrated in FIG. 11 in which a cross section of a locking member 18 appears, and illustrating a released position of the locking member 18.

The locking member 18 is movable between a locking position (see FIG. 6) and a released position (see FIG. 12). More specifically, the locking member 18 is pivotally movable between the locking position and the released position. The locking member 18 includes a spring 18C. The locking member 18 is pressed toward the locking position by the spring 18C.

The locking member 18 includes a shaft 18A and a protrusion 18B. The shaft 18A is rotatably supported by the second cover 15. Thus, the locking member 18 is pivotally movable relative to the second cover 15. The protrusion 18B extends from the shaft 18A toward the protrusion 14. In a state where the locking member 18 is positioned at the locking position, the protrusion 18B faces one end portion of the flat plate part 14B. The one end portion of the flat plate part 14B faces the first frame 16A (see FIG. 1) in the second direction in a case where the shutter 13 is at the closed position. The protrusion 18B contacts the one end portion of the protrusion 14. With this configuration, the locking member 18 at the locking position locks the protrusion 14 to the second cover 15. "Locking the protrusion 14 to the second cover 15" denotes that the locking member 18 prevents the protrusion 14 from pivotally moving relative to the second cover 15 in a clockwise direction in FIG. 6. In a case where the toner cartridge 1 is detached from the developing unit 31 described later, the locking member 18 locks the protrusion 14 to the second cover 15, whereby the shutter 13 is maintained at the closed position. In a state where the locking member 18 is positioned at the released position, the protrusion 18B separates from the one end portion of the flat plate part 14B. With this configuration, the locking member 18 releases the protrusion 14 from the second cover 15 in a case where the locking member 18 is positioned at the released position.

The spring 18C is a coil spring. The spring 18C includes one end portion, another end portion positioned away from the one end portion, and a coil portion positioned between the one end portion and the other end portion. The one end portion of the spring 18C contacts the second cover 15. The other end portion of the spring 18C contacts the protrusion 18B of the locking member 18. Thus, the spring 18C presses the locking member 18 toward the locking position.

The stopper 19 is positioned at an inner surface of the second flame 16B. The stopper 19 protrudes from the inner surface of the second frame 16B toward the first frame 16A.

In a state where the shutter 13 is at the closed position, the stopper 19 faces another end portion of the flat plate part 14B. The other end portion of the flat plate part 14B faces the second frame 16B in the second direction in the closed position of the shutter 13. The other end portion of the flat plate part 14B includes an engagement part 14D. The engagement part 14D protrudes from the other end portion of the flat plate part 14B in the second direction in the closed position of the shutter 13. The stopper 19 faces and contacts the engagement part 14D. In this way, the stopper 19 prevents the protrusion 14 from pivotally moving relative to the second cover 15 in a counter-clockwise direction in FIG. 6 from the closed position of the shutter 13.

2.5 Gear Cover 21 and Protrusion 22

As illustrated in FIG. 1, the toner cartridge 1 includes a gear cover 21 and a protrusion 22. The gear cover 21 is positioned opposite to the cover 12 with respect to the casing 2 from in the first direction. The gear 23 has at least a portion covered with the gear cover 21. The protrusion 22 is positioned opposite to the first toner-accommodating section 2A with respect to the gear 23 in the first direction. The protrusion 22 protrudes outward of the gear cover 21 in the first direction. The protrusion 22 extends in the second direction.

2.6 Gear Parts and Protrusions

As illustrated in FIGS. 1 and 4, the toner cartridge 1 includes a gear part 24A, a gear part 24B, a second protrusion 25A, a second protrusion 25B, a first protrusion 26A, and a first protrusion 26B. The gear part 24A, the gear part 24B, the second protrusion 25A, the second protrusion 25B, the first protrusion 26A, and the first protrusion 26B are components for moving a developing shutter 51 of the developing unit 31 described later. Specifically, the first protrusion 26A is a component for releasing the locking of the developing shutter 51 described later by a locking member 52A described later. The first protrusion 26B is a component for releasing the locking of the developing shutter 51 described later by a locking member 52B described later. The gear part 24A and the gear part 24B moves the developing shutter 51 described later between an open position and a closed position. The second protrusion 25A and the second protrusion 25B are components for maintaining the developing shutter 51 moved from the open position toward the closed position by the gear part 24A and the gear part 24B at the closed position.

The gear part 24A and the gear part 24B are positioned at the cover 12. The gear part 24A is positioned away from the gear part 24B in the first direction. The second opening 12A is positioned at a position between the gear part 24A and the gear part 24B. In other words, the gear part 24A is positioned at one side of the second opening 12A in the first direction. Further, the gear part 24B is positioned at another side of the second opening 12A in the first direction. Each of the gear part 24A and the gear part 24B includes a plurality of gear teeth. In other words, the cover 12 includes a plurality of gear teeth. The plurality of gear teeth of the gear part 24A and the plurality of gear teeth of the gear part 24B are positioned at a portion of the circumferential surface of the cover 12. The plurality of gear teeth of the gear part 24A and the plurality of gear teeth of the gear part 24B are positioned at the circumferential surface of the cover 12 along the rotating direction of the toner conveyance unit 4. Each of the plurality of gear teeth of the gear part 24A and the plurality of gear teeth of the gear part 24B is arrayed in the rotating direction of the toner conveyance unit 4.

The second protrusion 25A and the second protrusion 25B are positioned at the cover 12. The second protrusion 25A is positioned away from the second protrusion 25B in the first direction. The second protrusion 25A and the plurality of gear teeth of the gear part 24A are aligned in the rotating direction of the toner conveyance unit 4 (rotating direction of the cover 12 relative to the shutter 13). The second protrusion 25B and the plurality of gear teeth of the gear part 24B are aligned in the rotating direction of the toner conveyance unit 4. The second protrusion 25A is positioned at upstream side of the plurality of gear teeth of the gear part 24A in a moving direction of the cover 12 in a case where the casing 2 is pivotally moved from the second position to the first position. A gap length between the second protrusion 25A and a gear tooth closest to the second protrusion 25A among the plurality of gear teeth of the gear part 24A in the rotating direction of the toner conveyance unit 4 is greater than an interval between neighboring gear teeth of the gear part 24A in the rotating direction of the toner conveyance unit 4. Specifically, the gap length between the second protrusion 25A and the gear tooth of the gear part 24A closest to the second protrusion 25A in the rotating direction of the toner conveyance unit 4 is equal to a pitch length of the plurality of gear teeth of the gear part 24A. The second protrusion 25B is positioned at the upstream side of the plurality of gear teeth of the gear part 24B in the moving direction of the cover 12 in a case where the casing 2 is pivotally moved from the second position (see FIG. 21) to the first position (see FIG. 11). A gap length between the second protrusion 25B and a gear tooth closest to the second protrusion 25B among the plurality of gear teeth of the gear part 24B in the rotating direction of the toner conveyance unit 4 is greater than an interval between neighboring gear teeth of the gear part 24B in the rotating direction of the toner conveyance unit 4. Specifically, the gap length between the second protrusion 25B and the gear tooth of the gear part 24B closest to the second protrusion 25B in the rotating direction of the toner conveyance unit 4 is equal to a pitch length of the plurality of gear teeth of the gear part 24B. The second protrusion 25A and the second protrusion 25B protrude toward an opposite side of the second toner-accommodating section 2B with respect to the first toner-accommodating section 2A in the second direction.

The first protrusion 26A is positioned opposite to the second opening 12A with respect to the plurality of gear teeth of the gear part 24A in the first direction. The first protrusion 26B is positioned opposite to the second opening 12A with respect to the plurality of gear teeth of the gear part 24B in the first direction. The first protrusion 26A is positioned at the one end portion of the first toner-accommodating section 2A, and the first protrusion 26B is positioned at the other end portion of the second cover 15. The first protrusion 26A and the first protrusion 26B protrude toward the opposite side of the second toner-accommodating section 2B with respect to the first toner-accommodating section 2A in the second direction. Each of distal end portions of the first protrusion 26A and the first protrusion 26B is positioned farther from the toner conveyance unit 4 than distal end portions of the plurality of gear teeth of the gear part 24A and the plurality of gear teeth of the gear part 24B from the toner conveyance unit 4. Consequently, in a case where the toner cartridge 1 is attached to the developing unit 31, the first protrusion 26A can reliably contact the locking member 52A described later, and the first protrusion 26B can reliably contact the locking member 52B described later.

3. Details of Developing Unit 31

Figure 7:
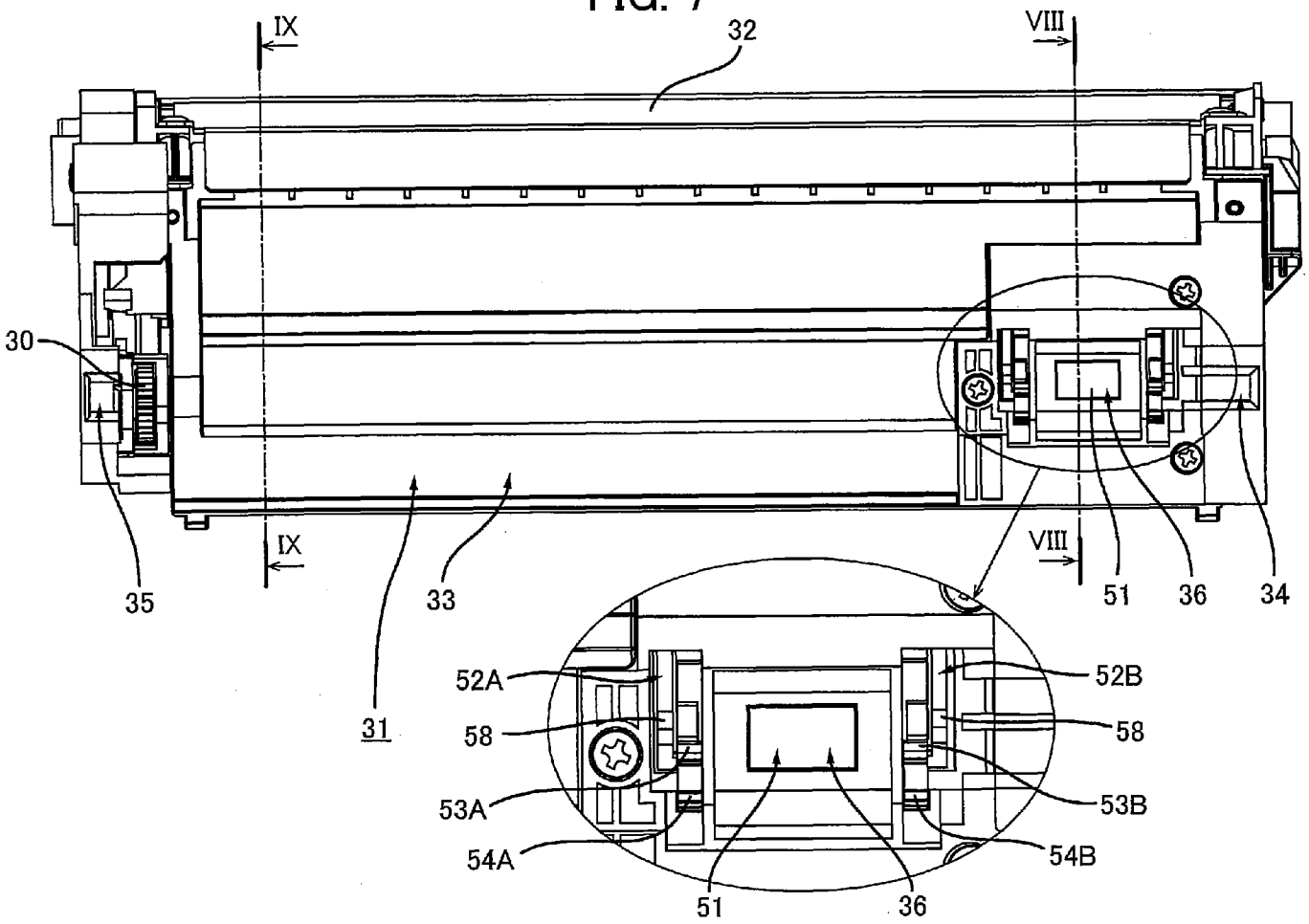
FIG. 7 is a side view of a developing unit 31 as viewed in a mounting direction for mounting of the toner cartridge 1 on the developing unit 31.
Figure 8:
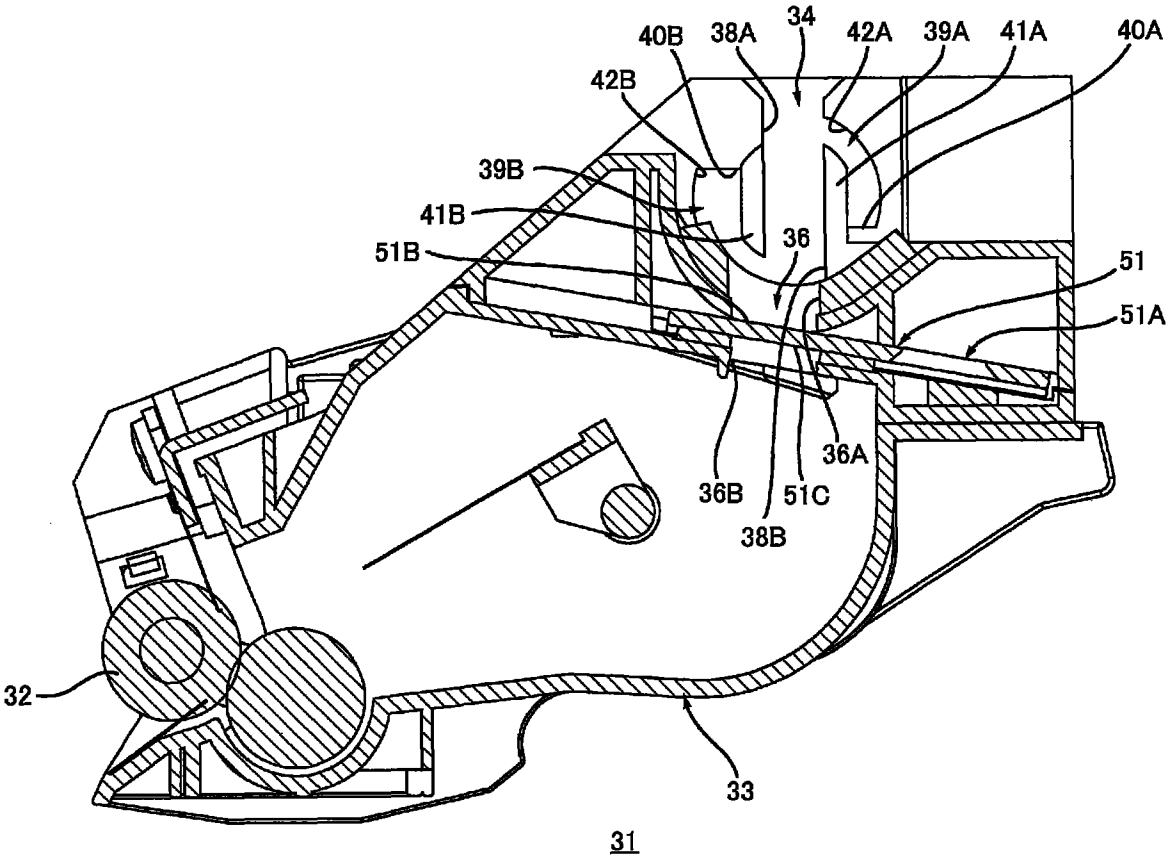
FIG. 8 is a cross-sectional view of the developing unit 31 taken along a line VIII-VIII illustrated in FIG. 7 as viewed in a direction toward a groove 34 in the first direction.
Figure 9:
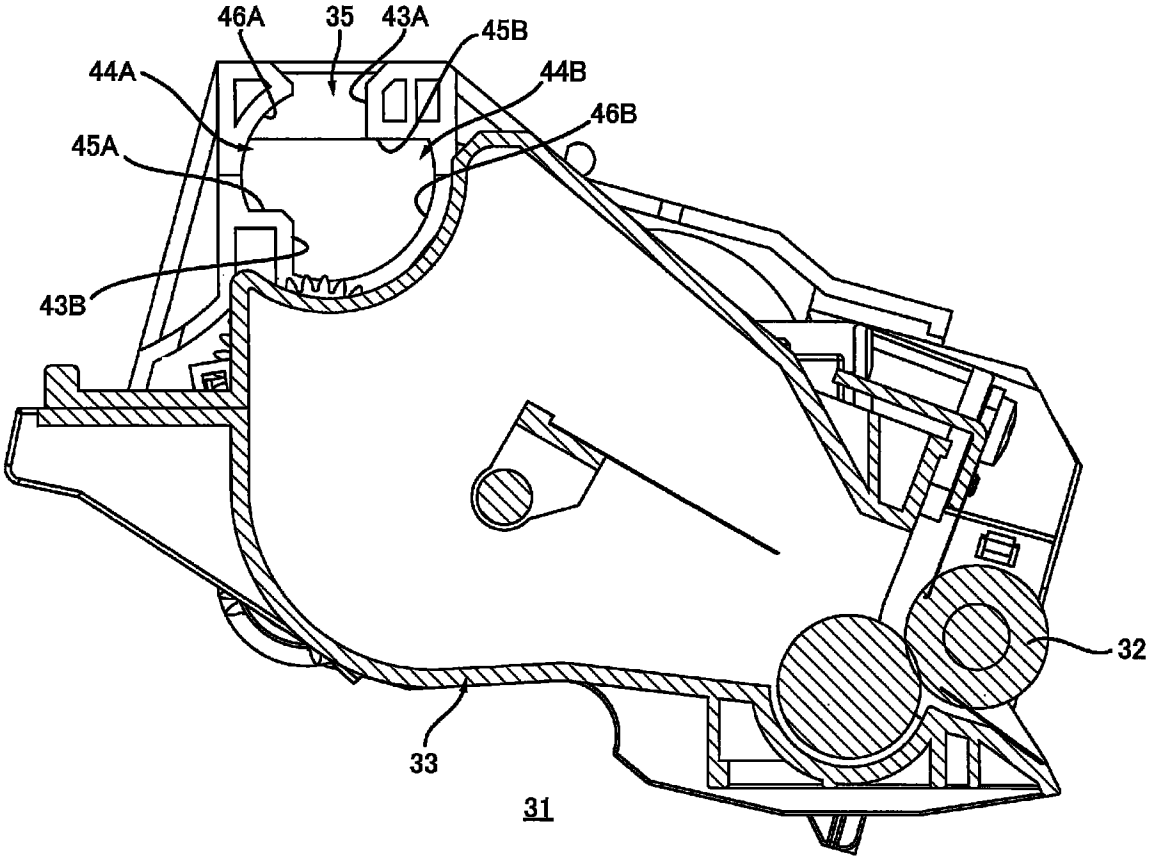
FIG. 9 is a cross-sectional view of the developing unit 31 taken along a line IX-IX in FIG. 7 as viewed in a direction toward a groove 35 in the first direction.

The developing unit 31 illustrated in FIGS. 7 through 9 is a component for receiving toner from the toner cartridge 1. For example, the developing unit 31 is a component for developing an image by using toner supplied from the toner cartridge 1. In the present embodiment, the developing unit 31 includes a developing roller 32. The developing unit 31 may include a photosensitive member. The developing unit 31 may be a cartridge type detachably attachable to an image forming apparatus. The developing roller 32 extends in the first direction. The developing roller 32 can contact a photosensitive member. The developing unit 31 includes a toner-accommodating section 33 configured to accommodate toner therein.

The developing unit 31 has a groove 34, a groove 35, and an opening 36. The groove 34 is positioned at one end portion of the developing unit 31 in the first direction. The groove 35 is positioned at another end portion of the developing unit 31 in the first direction. The groove 35 is positioned at a position separated from the groove 34 in the first direction. The detail of the grooves 34 and 35 will next be described.

3.1 Groove 34

As illustrated in FIGS. 8 and 11, the groove 34 extends in a mounting direction along which the toner cartridge 1 is attached to the developing deice 31. The mounting direction is indicated by an arrow in FIG. 10. The groove 34 has one end portion and another end portion in the mounting direction. The one end portion is farther from the opening 36 than the other end portion in the mounting direction. The groove 34 has a sufficient width for receiving the protrusion 14 and the cover part 16 of the toner cartridge 1 (see FIG. 1) in a direction intersecting with the mounting direction. The groove 34 includes a flat surface 38A, a flat surface 38B, a recess 39A, a recess 39B, a protrusion 41A, and a protrusion 41B.

3.1.1 Flat Surface 38A and Flat Surface 38B

The flat surface 38A is positioned at the one end portion of the groove 34. The flat surface 38B is positioned at the other end portion of the groove 34. Both of the flat surface 38A and the flat surface 38B extend in the mounting direction. The flat surface 38A faces the first frame 16A (see FIG. 1) of the cover part 16 in a case where the toner cartridge 1 is attached to the developing unit 31. The flat surface 38B faces the second frame 16B (see FIG. 1) of the cover part 16 in a case where the toner cartridge 1 is attached to the developing unit 31. In a case where the casing 2 is pivotally moved from the second position (see FIG. 20) to the first position (see FIG. 11) relative to the developing unit 31, at least one of the flat surface 38A and the flat surface 38B contacts the cover part 16, and maintains the casing 2 at the first position.

3.1.2 Recess 39A and Recess 39B

As illustrated in FIGS. 8, 11, 20, and 21, the recess 39A is recessed in a direction away from the flat surface 38A in a width direction of the groove 34. The recess 39B is recessed in a direction away from the flat surface 38B in the width direction of the groove 34. The recess 39A includes an arcuate surface 42A and a flat surface 40A. The recess 39B includes an arcuate surface 42B and a flat surface 40B. The arcuate surface 42A is curved (extends) along a direction in which the first frame 16A is moved in a case where the casing 2 is pivotally moved from the first position to the second position relative to the developing unit 31. The arcuate surface 42B is curved (extends) along a direction in which the second frame 16B is moved when the casing 2 is pivotally moved from the first position to the second position relative to the developing unit 31. The flat surface 40A is positioned at a downstream end of the arcuate surface 42A in the direction in which the first frame 16A is moved in a case where the casing 2 is pivotally moved from the first position to the second position relative to the developing unit 31. The flat surface 40B is positioned at a downstream end of the arcuate surface 42B in the direction in which the second frame 16B is moved when the casing 2 is pivotally moved from the first position to the second position relative to the developing unit 31. Both of the flat surface 40A and the flat surface 40B extend in the direction intersecting with the mounting direction. More specifically, the flat surface 40A and the flat surface 40B extend in a direction perpendicular to the mounting direction. In a case where the casing 2 is pivotally moved from the first position to the second position relative to the developing unit 31, at least one of the flat surface 40A and the flat surface 40B contacts the cover part 16, and maintains the casing 2 at the second position.

3.1.3 Protrusion 41A and Protrusion 41B

The protrusion 41A and the protrusion 41B are positioned between the arcuate surface 42A and the arcuate surface 42B in the width direction of the groove 34. The protrusion 41A is positioned between the arcuate surface 42A and the protrusion 41B in the width direction of the groove 34. The protrusion 41B is positioned between the arcuate surface 42B and the protrusion 41A in the width direction of the groove 34. The protrusion 41B is positioned away from the protrusion 41A in the width direction of the groove 34. Both of the protrusion 41A and the protrusion 41B extend in the mounting direction. In a case where the toner cartridge 1 is attached to the developing unit 31, the flat plate part 14B (see FIG. 12) is positioned between the protrusion 41A and the protrusion 41B. In a case where the toner cartridge 1 is attached to the developing unit 31, the protrusion 41A and the protrusion 41B contact the flat plate part 14B. With this configuration, in a case where the toner cartridge 1 is attached to the developing unit 31, the protrusion 41A and the protrusion 41B prevent the protrusion 14 from pivotally moving. Consequently, the shutter 13 is fixed relative to the developing unit 31.

On the other hand, in a case where the toner cartridge 1 is attached to the developing unit 31, the protrusion 41A and the protrusion 41B do not contact the first frame 16A, the second frame 16B, and the third frame 16C (see FIG. 1) in the width direction of the groove 34. In this way, in a case where the toner cartridge 1 is attached to the developing unit 31, the first frame 16A, the second frame 16B, and the third frame 16C are pivotally movable relative to the shutter 13 while the shutter 13 is fixed to the developing unit 31. Consequently, the casing 2 is pivotally movable relative to the developing unit 31 together with the cover 12 and the second cover 15 while the shutter 13 is fixed to the developing unit 31. In a case where the casing 2 is pivotally moved from the first position (see FIG. 11) to the second position (see FIG. 21) together with the cover 12 and the second cover 15 relative to the developing unit 31, the shutter 13 is at the open position relative to the casing 2. In the open position (see FIG. 23) of the shutter 13, at least the portion of the third opening 13D overlaps at least the portion of the second opening 12A, and the second opening 12A and the third opening 13D are opened.

The protrusion 41A is positioned away from the arcuate surface 42A in a radial direction of the arcuate surface 42A. A gap between the protrusion 41A and the arcuate surface 42A in the radial direction of the arcuate surface 42A is greater than a length of the first frame 16A (see FIG. 1) in the mounting direction. Thus, the first frame 16A can pass through the gap between the protrusion 41A and the arcuate surface 42A in a case where the casing 2 is pivotally moved relative to the developing unit 31. Similarly, the protrusion 41B is positioned away from the arcuate surface 42B in a radial direction of the arcuate surface 42B. A gap between the protrusion 41B and the arcuate surface 42B in the radial direction of the arcuate surface 42B is greater than a length of the second frame 16B (see FIG. 1) in the mounting direction. Thus, the second frame 16B can pass through the gap between the protrusion 41B and the arcuate surface 42B when the casing 2 is pivotally moved relative to the developing unit 31.

3.2 Groove 35

As illustrated in FIG. 9, the groove 35 extends in the mounting direction. The groove 35 includes one end portion and another end portion in the mounting direction. The one end portion is farther from the toner-accommodating section 33 than the other end portion from the toner-accommodating section 33 in the mounting direction. The groove 35 has a sufficient width for receiving the protrusion 22 (see FIG. 1) of the toner cartridge 1 in the direction intersecting with the mounting direction. The groove 35 includes a flat surface 43A, a flat surface 43B, a recess 44A, and a recess 44B.

3.2.1 Flat Surface 43A and Flat Surface 43B

The flat surface 43A is positioned at the one end portion of the groove 35. The flat surface 43B is positioned at the other end portion of the groove 35. Both of the flat surface 43A and the flat surface 43B extend in the mounting direction. In a case where the toner cartridge 1 is attached to the developing unit 31, the flat surface 43A faces one end portion of the protrusion 22, and the flat surface 43B faces another end portion of the protrusion 22. In a case where the casing 2 is pivotally moved from the second position to the first position relative to the developing unit 31, at least one of the flat surfaces 43A and 43B contacts the protrusion 22, and maintains the casing 2 at the first position.

3.2.2 Recess 44A and Recess 44B

The recess 44A is recessed in a direction away from the flat surface 43A in a width direction of the groove 35. The recess 44B is recessed in a direction away from the flat surface 43B in the width direction of the groove 35. The recess 44A includes an arcuate surface 46A and a flat surface 45A. The recess 44B includes an arcuate surface 46B and a flat surface 45B. The arcuate surface 46A is curved (extends) along a direction in which the one end portion of the protrusion 22 is moved when the casing 2 is pivotally moved from the first position to the second position relative to the developing unit 31. The arcuate surface 46B is curved (extends) along a direction in which the other end portion of the protrusion 22 is moved in a case where the casing 2 is pivotally moved from the first position to the second position relative to the developing unit 31. The flat surface 45A is positioned at a downstream end of the arcuate surface 46A in the direction in which the one end portion of the protrusion 22 is moved in a case where the casing 2 is pivotally moved from the first position to the second position relative to the developing unit 31. The flat surface 45B is positioned at a downstream end of the arcuate surface 46B in the direction in which the other end portion of the protrusion 22 is moved in a case where the casing 2 is pivotally moved from the first position to the second position relative to the developing unit 31. Both of the flat surface 45A and the flat surface 45B extend in the direction intersecting with the mounting direction. More specifically, the flat surface 45A and the flat surface 45B extend in the direction perpendicular to the mounting direction. When the casing 2 is pivotally moved from the first position to the second position relative to the developing unit 31, at least one of the flat surface 45A and the flat surface 45B contacts the protrusion 22, and maintains the casing 2 at its second position.

3.3 Opening 36

As illustrated in FIG. 7, the opening 36 is positioned at a position between the groove 34 and the groove 35 in the first direction. The groove 34 is positioned at a position closer to the opening 36 than a center portion of the developing unit 31 to the opening 36 in the first direction. As illustrated in FIG. 8, the opening 36 penetrates an outer surface of the toner-accommodating section 33 in the mounting direction. The opening 36 has one end 36A exposed to the outer surface of the toner-accommodating section 33 and another end 36B in communication with an internal space of the toner-accommodating section 33 in the mounting direction.

3.4 Developing Shutter 51

Figure 23:
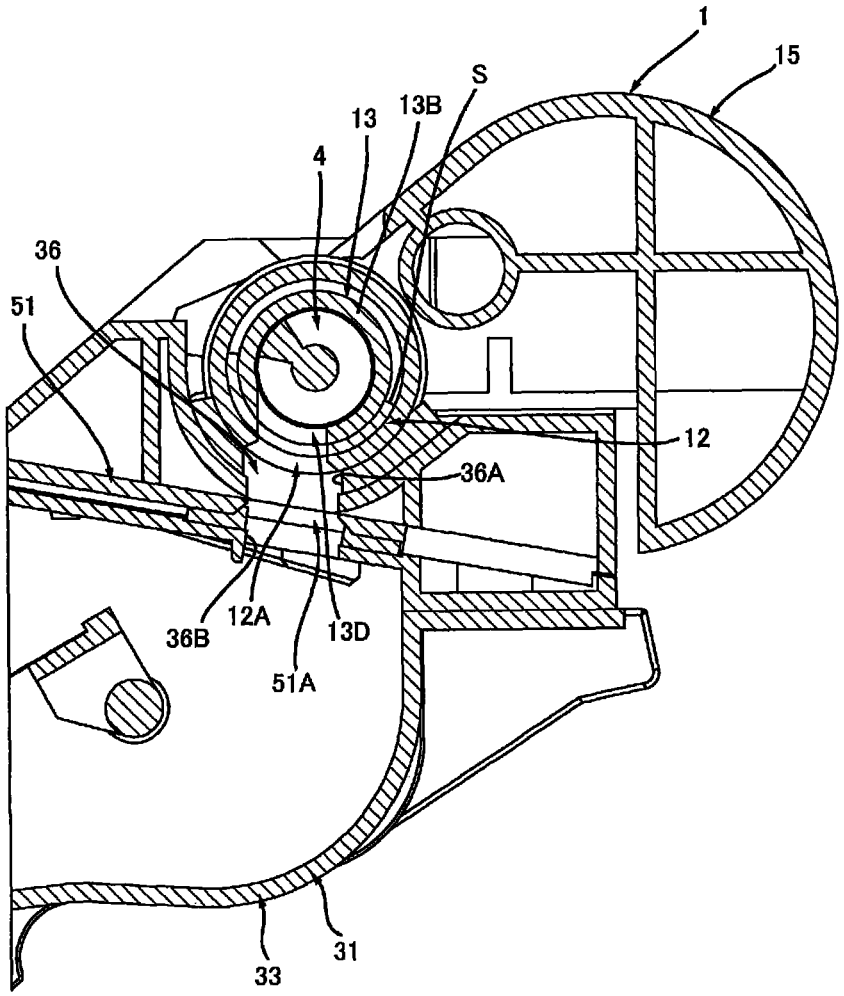
FIG. 23 is a cross-sectional view of the developing unit 31 and the toner cartridge 1 illustrated in FIG. 21 in which a cross section of the third opening 13D of the shutter 13 appears, and illustrating the open position of the shutter 13 and the open position of the developing shutter 51.

As illustrated in FIGS. 7 and 8, the developing unit 31 includes the developing shutter 51. The developing shutter 51 is a component for opening and closing the opening 36. The developing shutter 51 is positioned between the one end 36A and the other end 36B of the opening 36 in the mounting direction. The developing shutter 51 includes one surface 51B and another surface 51C in the mounting direction. The one surface 51B is positioned closer to the one end 36A than the other end 36B of the opening 36 to the one end 36A in the mounting direction. The other surface 51C is positioned closer to the other end 36B of the opening 36 than the one surface 51B to the other end 36B of the opening 36 in the mounting direction. The developing shutter 51 is movable between the closed position (see FIG. 13) for closing the opening 36 and the open position (see FIG. 23) for opening the opening 36. The developing shutter 51 has an opening 51A. The opening 51A penetrates the developing shutter 51 in the mounting direction. As illustrated in FIG. 23, in a case where the developing shutter 51 is positioned at the open position, the opening 51A overlaps at least a portion of the opening 36. With this configuration, in a case where the developing shutter 51 is positioned at the open position, the opening 51A allows toner in the toner cartridge 1 to he introduced into the toner-accommodating section 33 through the opening 36 and the opening 51A.

Figure 15:
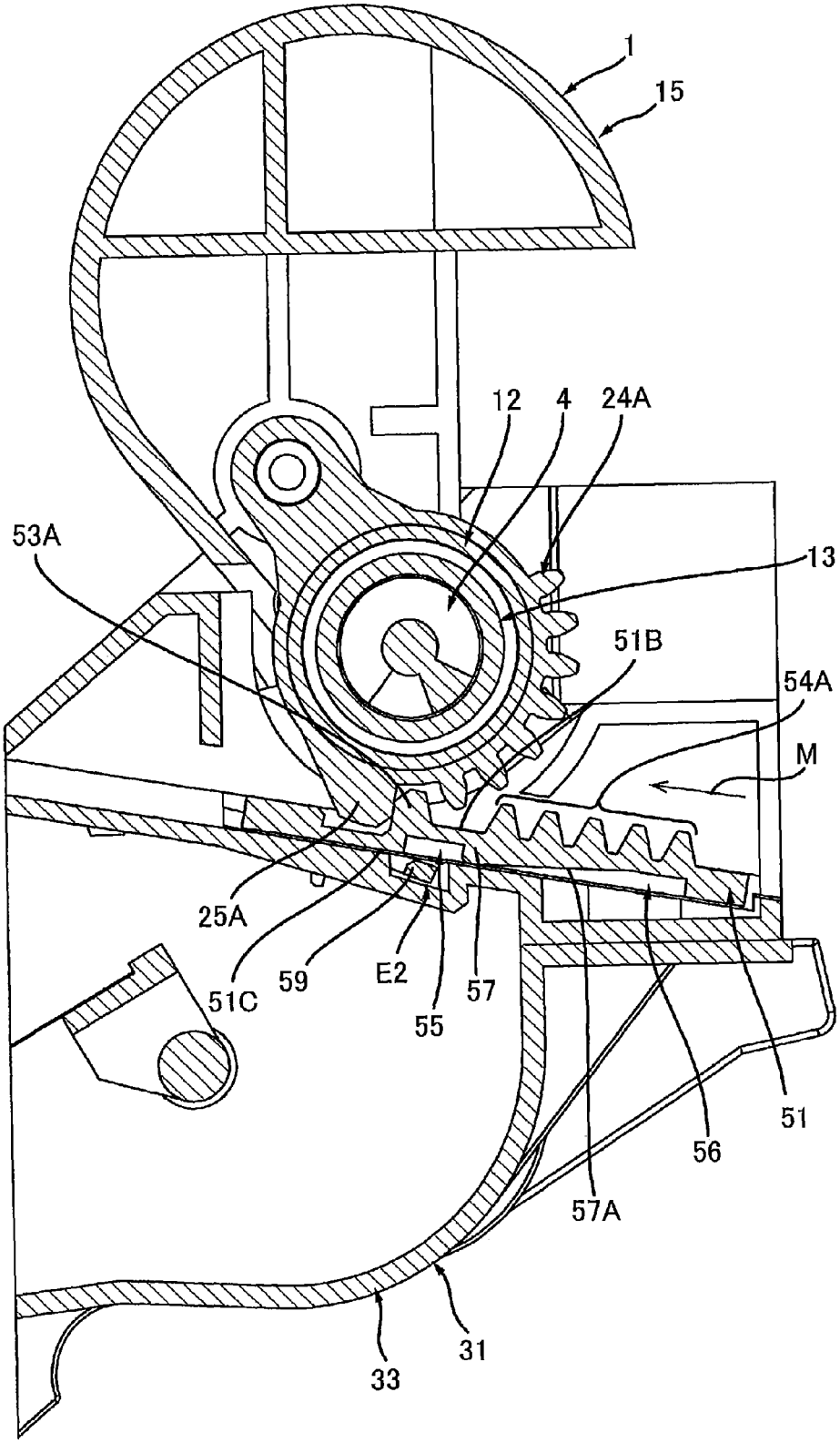
FIG. 15 is a cross-sectional view of the developing unit 31 and the toner cartridge 1 illustrated in FIG. 11 in which a cross section of a gear part 54A of the developing shutter 51 appears, and illustrating the first position of the casing 2, and also illustrating a state where a protrusion 53A of the developing shutter 51 is positioned between a second protrusion 25A of the toner cartridge 1 and a gear part 24A of the toner cartridge 1.

As illustrated in FIGS. 7 and 15, the developing shutter 51 includes a protrusion 53A, a protrusion 53B, a gear part 54A, and a gear part 54B.

The protrusion 53A is configured to contact the gear part 24A (see FIG. 17) in a case where the toner cartridge 1 is attached to the developing unit 31 and the casing 2 is pivotally moved from the first position to the second position relative to the developing unit 31. Similarly, the protrusion 53B is configured to contact the gear part 24B (see FIG. 1) in a case where the toner cartridge 1 is attached to the developing unit 31 and the casing 2 is pivotally moved from the first position to the second position relative to the developing unit 31. The gear part 54A is a configuration for meshing with the gear part 24A (see FIG. 19) of the toner cartridge 1 in a case where the toner cartridge 1 is attached to the developing unit 31. Similarly, the gear part 54B is a configuration for meshing with the gear part 24B (see FIG. 1) of the toner cartridge 1 in a case where the toner cartridge 1 is attached to the developing unit 31. In a case where the casing 2 is pivotally moved from the first position toward the second position relative to the developing unit 31, the gear tooth of the gear part 24A closest to the second protrusion 25A presses the protrusion 53A, and the gear tooth of the gear part 24B closest to the second protrusion 25B presses the protrusion 53B. As a result, the developing shutter 51 starts moving from the closed position toward the open position. After each of the protrusion 53A and the protrusion 53B is pressed by corresponding each of the gear tooth of the gear part 24A closest to the second protrusion 25A and the gear tooth of the gear part 24B closest to the second protrusion 25B, the rest of the plurality of gear teeth of the gear part 24A are meshed with the gear part 54A, and the rest of the plurality of gear teeth of the gear part 24B are meshed with the gear part 54B. Consequently, the developing shutter 51 is brought into the open position. The protrusion 53A is also configured to contact the second protrusion 25A (see FIG. 15) in a case where the casing 2 is pivotally moved from the second position toward the first position relative to the developing unit 31. Similarly, the protrusion 53B is also configured to contact the second protrusion 25B (see FIG. 1) in a case where the casing 2 is pivotally moved from the second position toward the first position relative to the developing unit 31. In a case where the casing 2 is pivotally moved from the second position toward the first position relative to the developing unit 31, the gear part 24A separates from the gear part 54A, and the gear part 24B separates from the gear part 54B. Then, the second protrusion 25A presses the protrusion 53A, and the second protrusion 25B presses the protrusion 53B. Consequently, the developing shutter 51 is brought into the closed position.

The protrusion 53A is positioned opposite to the groove 34 with respect to the opening 36 in the first direction. The protrusion 53B is positioned between the opening 36 and the groove 34 in the first direction. The protrusion 53A and the protrusion 53B are positioned at the one surface 51B of the developing shutter 51. The protrusion 53A and the protrusion 53B protrude from the one surface 51B of the developing shutter 51 toward a direction opposite to the mounting direction. The protrusion 53A and the protrusion 53B are exposed to the outer surface of the toner-accommodating section 33 in a case where the developing shutter 51 is positioned at the closed position.

The gear part 54A is positioned at an upstream side of the protrusion 53A in a moving direction M (see FIG. 15) of the developing shutter 51 in a case where the developing shutter 51 is moved from the closed position toward the open position. The gear part 54A is positioned away from the protrusion 53A in the moving direction M of the developing shutter 51. The gear part 54B is positioned at an upstream side of the protrusion 53B in the moving direction M of the developing shutter 51. The gear part 54B is positioned away from the protrusion 53B in the moving direction M of the developing shutter 51. Each of the gear part 54A and the gear part 54B includes a plurality of gear teeth arranged along the moving direction M of the developing shutter 51.

As illustrated in FIGS. 15, 17, 19, and 22, the developing shutter 51 has a recess 55, a recess 56, and a protrusion 57. The recess 55 is a configuration for receiving a protrusion 59 described later in the state where the toner cartridge 1 is detached from the developing unit 31 and the developing shutter 51 is positioned at the closed position. In the state where the toner cartridge 1 is detached from the developing unit 31, the protrusion 57 contacts the protrusion 59 fitted in the recess 55, so that the protrusion 57 can prevent the developing shutter 51 at the closed position from moving toward the open position. The recess 56 is for receiving the protrusion 59 in the state where the toner cartridge 1 is attached to the developing unit 31 and the developing shutter 51 is positioned at the open position. The recess 55, the recess 56 and the protrusion 57 are positioned at the other surface 51C of the developing shutter 51. The recess 56 is positioned at an upstream side of the recess 55 in the moving direction M of the developing shutter 51. The protrusion 57 is positioned between the recess 55 and the recess 56 in the moving direction M of the developing shutter 51. The recess 55 and the recess 56 are recessed from the other surface 51C of the developing shutter 51 toward the one surface 51B. The protrusion 57 protrudes in a direction from the one surface 51B toward the other surface 51C. The protrusion 57 includes a sloped surface 57A. The sloped surface 57A slopes toward the one surface 51B of the developing shutter 51 as the sloped surface 57A approaches the recess 56 from the recess 55.

3.5 Locking Members

As illustrated in FIG. 7, the developing unit 31 includes the locking member 52A and the locking member 52B. The locking member 52A and the locking member 52B are components for locking the developing shutter 51 to the closed position in the state where the toner cartridge 1 is detached from the developing unit 31. "Locking the developing shutter 51 to the closed position" denotes that the locking member 52A and the locking member 52B prevent the developing shutter 51 from moving from the closed position toward the open position. In the state where the toner cartridge 1 is detached from the developing unit 31 and the developing shutter 51 is positioned at the closed position, the locking member 52A is engaged with one end portion of the developing shutter 51 in the first direction. Similarly, the locking member 52B is engaged with another end portion of the developing shutter 51 in the first direction in the state where the toner cartridge 1 is detached from the developing unit 31 and the developing shutter 51 is positioned at the closed position. The other end portion of the developing shutter 51 is positioned closer to the groove 34 than the one end portion of the developing shutter 51 to the groove 34 in the first direction. Each of the locking member 52A and the locking member 52B is movable between a locking position (see FIG. 18) and a released position (see FIG. 14).

The locking member 52A is positioned opposite to the groove 34 with respect to the developing shutter 51 in the first direction. The locking member 52B is positioned between the developing shutter 51 and the groove 34 in the first direction. The locking member 52B is positioned away from the locking member 52A in the first direction. The developing shutter 51 is positioned between the locking member 52A and the locking member 52B in the first direction. The locking member 52A and the locking member 52B are exposed to the outer surface of the toner-accommodating section 33. Both of the locking member 52A and the locking member 52B extend in the moving direction M of the developing shutter 51.

Figure 14:
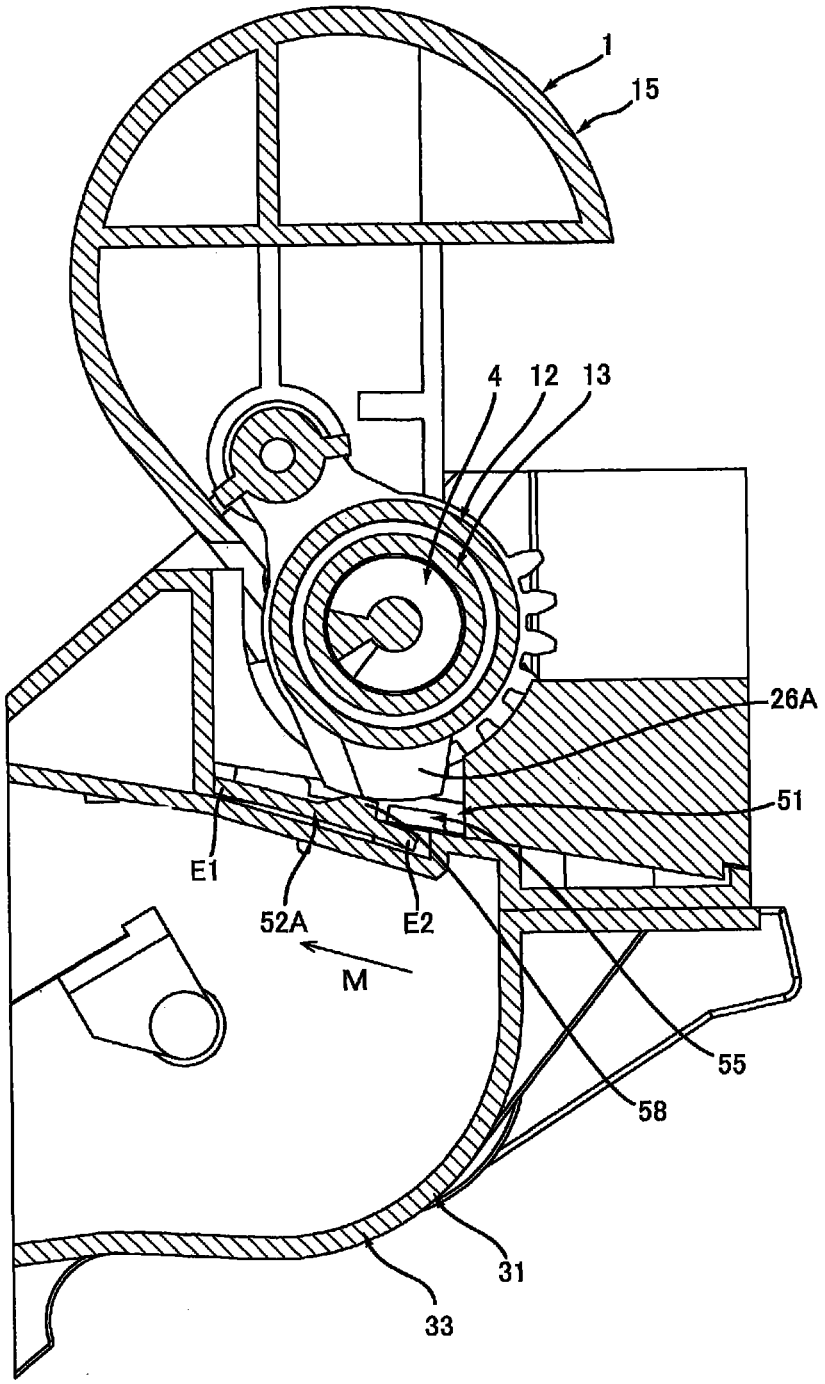
FIG. 14 is a cross-sectional view of the developing unit 31 and the toner cartridge 1 illustrated in FIG. 11 in which a cross section of a locking member 52A appears, and illustrating the first position of the casing 2, and also illustrating a state where a first protrusion 26A of the toner cartridge 1 contacts a protrusion 58 of the locking member 52A.
Figure 16:
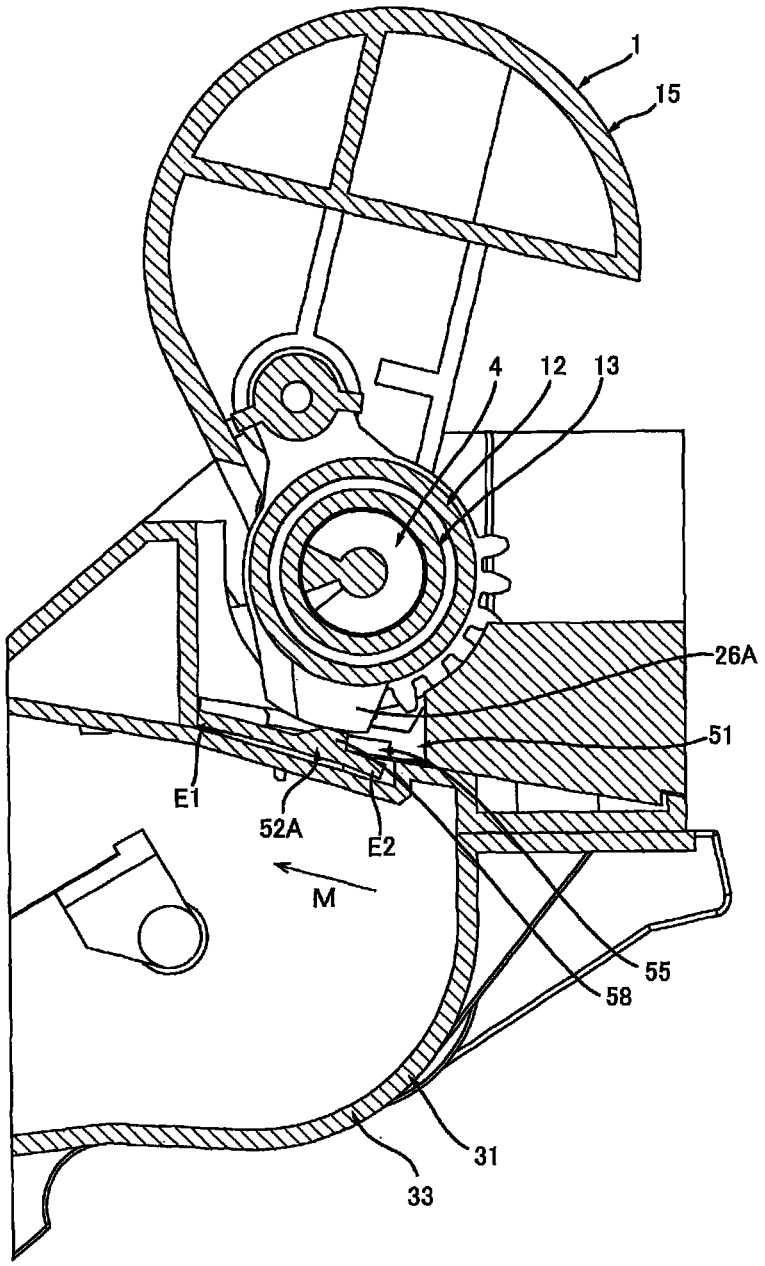
FIG. 16 is a cross-sectional view of the developing unit 31 and the toner cartridge 1 in which a cross section of the locking member 52A appears, and illustrating a state where the casing 2 is pivotally moved from the first position toward a second position and the first protrusion 26A of the toner cartridge 1 contacts the protrusion 58 of the locking member 52A.
Figure 18:
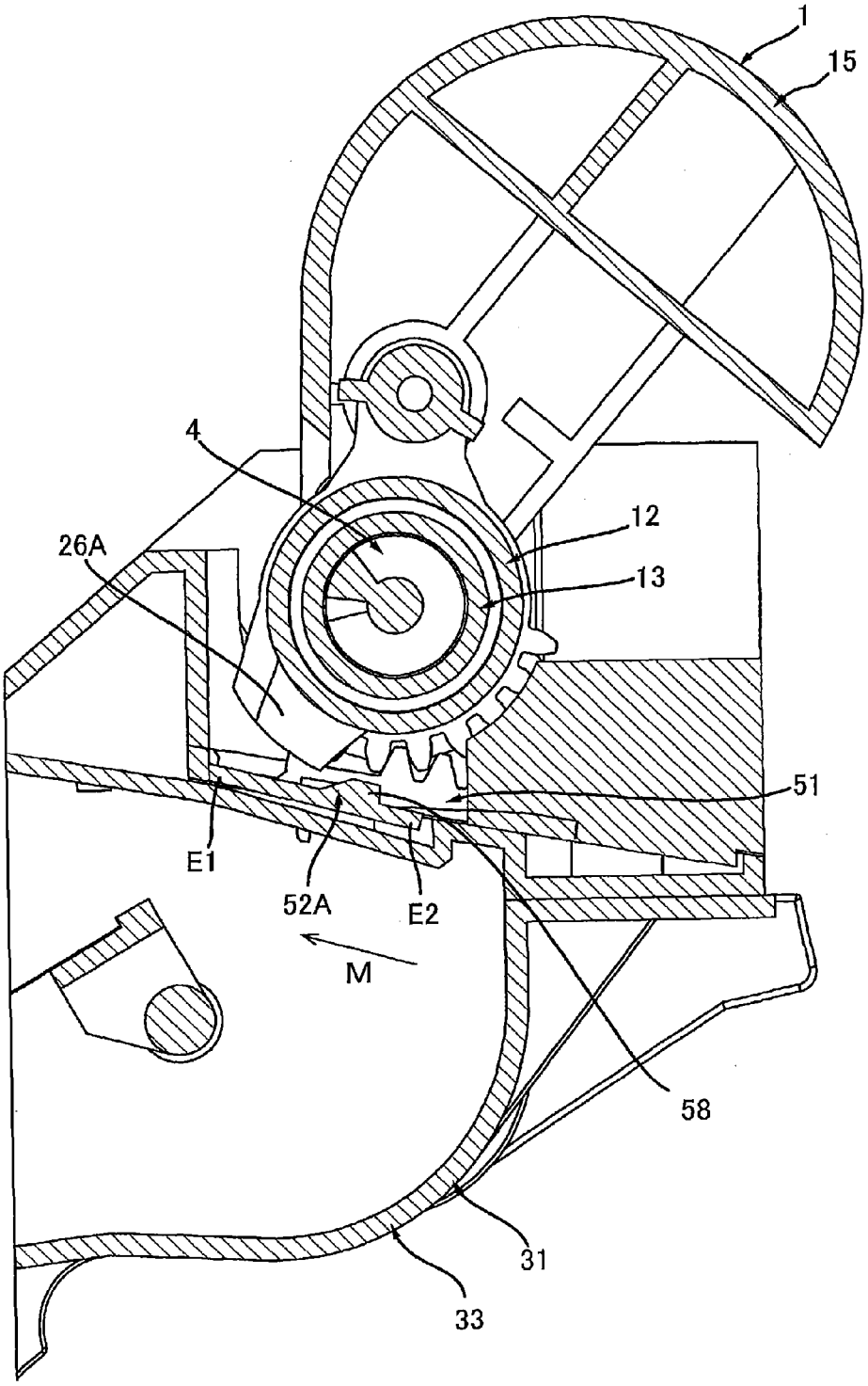
FIG. 18 is a cross-sectional view of the developing unit 31 and the toner cartridge 1 in which a cross section of the locking member 52A appears, and illustrating a state where the casing 2 is further pivotally moved toward the second position and the first protrusion 26A of the toner cartridge 1 is moved away from the protrusion 58 of the locking member 52A.

As illustrated in FIGS. 14, 16 and 18, each of the locking member 52A and the locking member 52B includes a base end portion E1 and a free end portion E2 positioned away from the base end portion E1 in the moving direction M of the developing shutter 51. Each of the free end portions E2 is positioned at an upstream side of corresponding each of the base end portions E1 in the moving direction M of the developing shutter 51. The base end portion E1 of the locking member 52A and the base end portion E1 of the locking member 52B are fixed to the developing unit 31. The locking member 52A and the locking member 52B are positioned away from the toner-accommodating section 33 in the mounting direction. Thus, both of the locking member 52A and the locking member 52B can be curved in the mounting direction. Each of the locking member 52A and the locking member 52B includes a protrusion 58 and the protrusion 59 (see FIG. 15).

The protrusion 58 of the locking member 52A protrudes from the locking member 52A in the direction opposite o the mounting direction (direction away from the toner-accommodating section 33). The protrusion 58 (see FIG. 7) of the locking member 52B protrudes from the locking member 52B in the direction opposite to the mounting direction (direction away from the toner-accommodating section 33). In the state where the toner cartridge 1 is attached to the developing unit 31, the protrusion 58 of the locking member 52A contacts the first protrusion 26A. The protrusion 58 of the locking member 52B contacts the first protrusion 26B (see FIG. 1) in the state where the toner cartridge 1 is attached to the developing unit 31.

As illustrated in FIGS. 15, 17, 19 and 22, the protrusion 59 of the locking member 52A is positioned at the free end portion E2 of the locking member 52A. Similarly, the protrusion 59 of the locking member 52B is positioned at the free end portion E2 of the locking member 52B. Both of the protrusions 59 of the locking member 52A and the locking member 52B extend in the first direction. In the state where the toner cartridge 1 is detached from the developing unit 31 and the developing shutter 51 is positioned at the closed position, the protrusions 59 are fitted into the recess 55 of the developing shutter 51. Because the protrusions 59 are fitted in the recess 55, the protrusions 59 contacts the protrusions 57 of the developing shutter 51, thereby preventing the developing shutter 51 from moving from the closed position toward the open position.

4. Attachment/Removal of Toner Cartridge 1 to/from Developing Unit 31

An operation for attachment of the toner cartridge 1 to the developing unit 31 and an operation for detachment of the toner cartridge 1 from the developing unit 31 will next be described with reference to FIGS. 10 through 22.

4.1 Attachment of Toner Cartridge 1 to Developing Unit 31

In a case where the toner cartridge 1 is attached to the developing unit 31, the protrusion 14 and the cover part 16 are fitted into the groove 34 as illustrated in FIG. 10, and the protrusion 22 is fitted into the groove 35. Therefore, the toner cartridge 1 is attached to the developing unit 31. At this time, as illustrated in FIG. 1, the casing 2 is positioned at the first position relative to the shutter 13. The shutter 13 is at the closed position relative to the cover 12, and the second opening 12A is closed by the shutter 13. That is, in the state where the casing 2 is positioned at the first position, the second opening 12A is closed by the shutter 13.

Through this operation, as illustrated in FIG. 11, the toner cartridge 1 is attached to the developing unit 31. Further, the protrusion 14 and the cover part 16 are fitted into the groove 34, and the protrusion 22 is fitted into the groove 35. At this time, as illustrated in FIG. 12, the protrusion 14 is subjected to positioning between the protrusion 41A and the protrusion 41B. That is, upon attachment of the toner cartridge 1 to the developing unit 31, the protrusion 14 is subjected to positioning relative to the developing unit 31.

At this time, the protrusion 41B contacts the protrusion 18B of the locking member 18, and the locking member 18 is moved from the locking position to the released position against the pressing force of the spring 18C. In other words, in the state where the toner cartridge 1 is attached to the developing unit 31, a portion of the developing unit 31 contacts the locking member 18, and the locking member 18 is moved from the locking position to the released position. With this configuration, the locking member 18 releases the protrusion 14 from the second cover 15 in the state where the toner cartridge 1 is attached to the developing unit 31. That is, the movement of the locking member 18 from the locking position to the released position makes the protrusion 14 pivotally movable relative to the second cover 15. In other words, the movement of the locking member 18 from the locking position to the released position allows the second cover 15 to be pivotally movable relative to the protrusion 14. Thus, the casing 2 is pivotally movable relative to the shutter 13 together with the cover 12 and the second cover 15. In other words, in the state where the toner cartridge 1 is attached to the developing unit 31, the casing 2 is pivotally movable between the first position and the second position relative to the toner conveyance unit 4 together with the cover 12 and the second cover 15.

Figure 13:
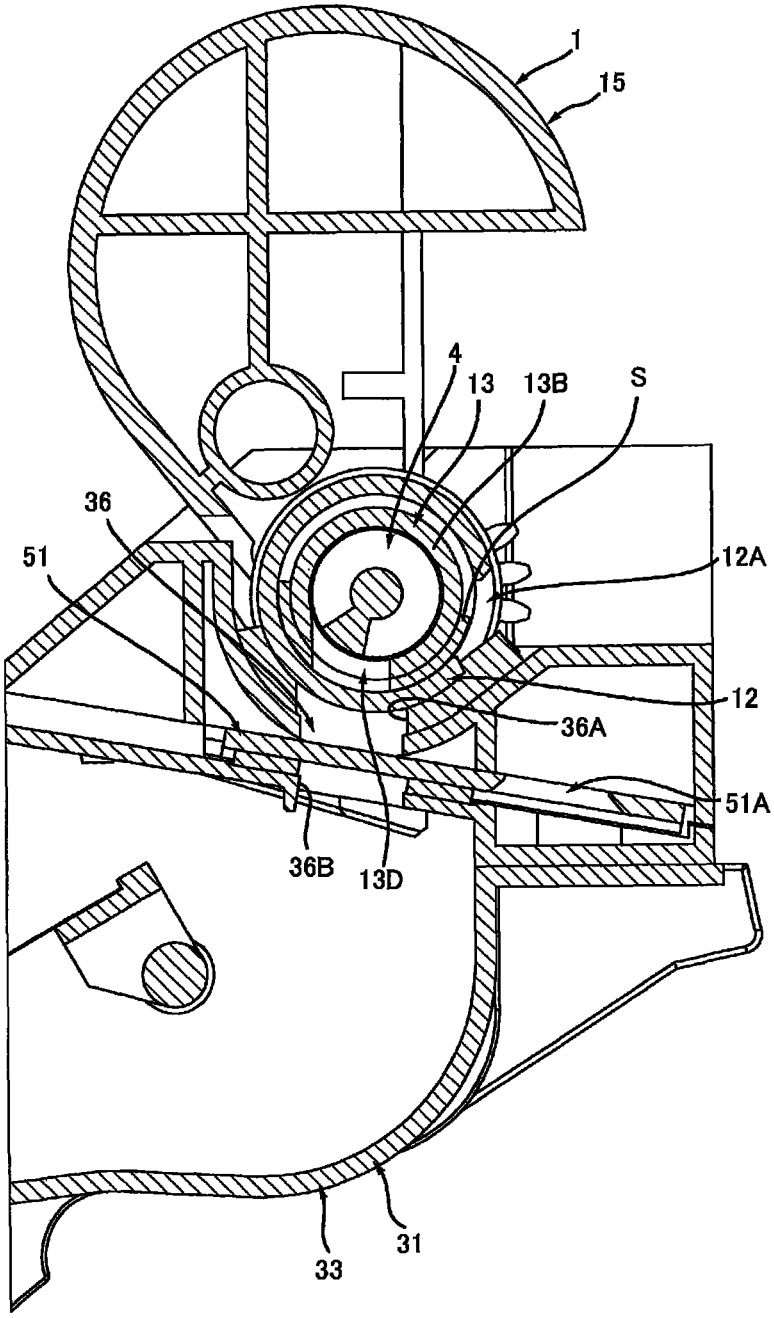
FIG. 13 is a cross-sectional view of the developing unit 31 and the toner cartridge 1 illustrated in FIG. 11 in which a cross section of a third opening 13D of the shutter 13 appears, and illustrating the first position of the casing 2, the closed position of the shutter 13, and a closed position of a developing shutter 51.

In this state, as illustrated in FIG. 13, the developing shutter 51 is positioned at the closed position. Further, as illustrated in FIG. 14, the first protrusion 26A of the toner cartridge 1 contacts the protrusion 58 of the locking member 52A. Similarly, the first protrusion 26B of the toner cartridge 1 contacts the protrusion 58 of the locking member 52B. Thus, the locking member 52A and the locking member 52B are curved such that the free end portions E2 are separated from the developing shutter 51. Consequently, as illustrated in FIG. 15, the protrusion 59 of the locking member 52A is moved so as to be out of the recess 55 of the developing shutter 51. Similarly, the protrusion 59 of the locking member 52B is moved so as to be out of the recess 55 of the developing shutter 51. At this time, the protrusion 53A of the developing shutter 51 is positioned between the second protrusion 25A and the gear part 24A of the toner cartridge 1. The protrusion 53B of the developing shutter 51 is positioned between the second protrusion 25B and the gear part 24B of the toner cartridge 1.

Figure 17:
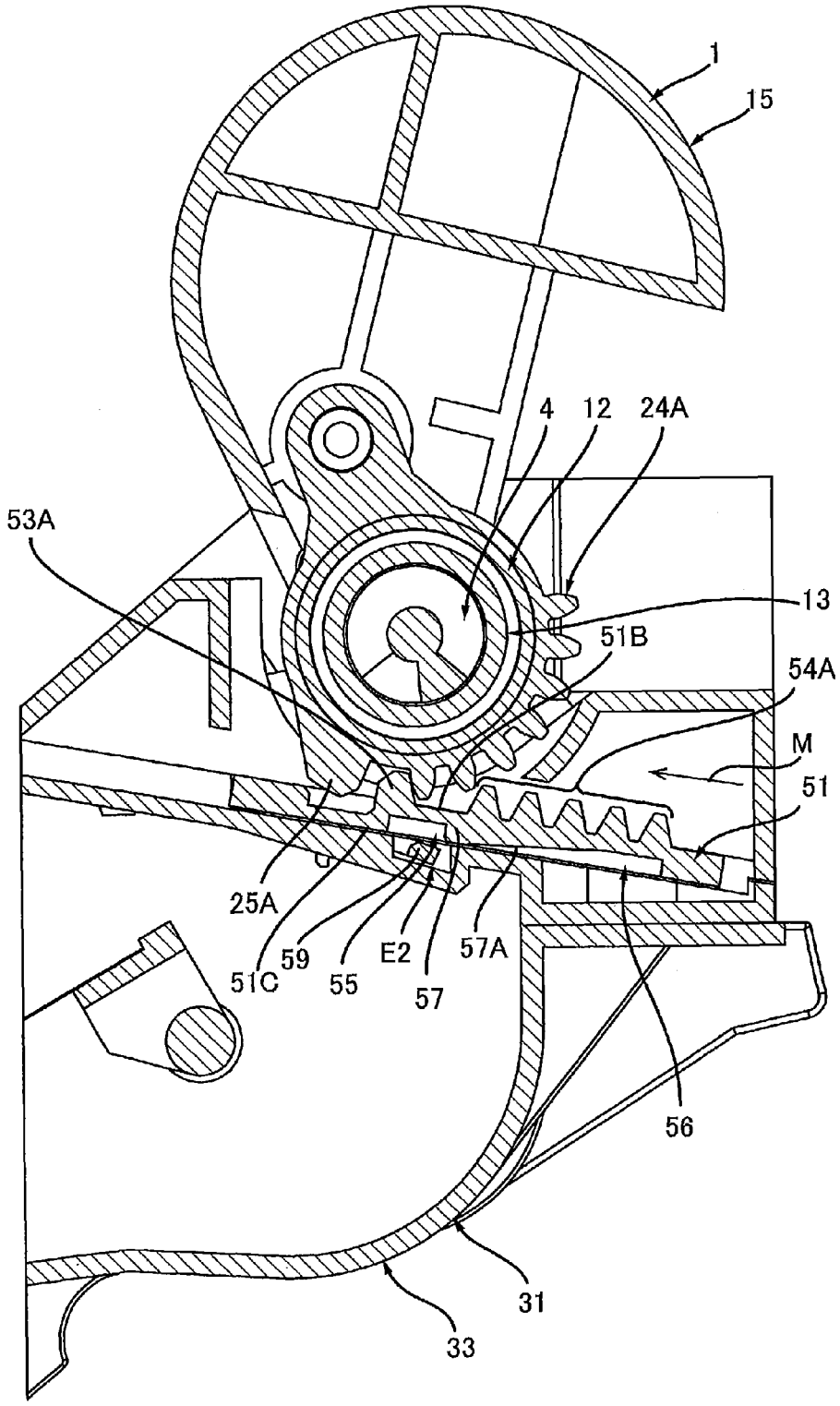
FIG. 17 is a cross-sectional view of the developing unit 31 and the toner cartridge 1 illustrated in FIG. 16 in which a cross section of the gear part 54A of the developing shutter 51 appears, and illustrating a state where the gear part 24A of the toner cartridge 1 contacts the protrusion 53A of the developing shutter 51.

Next, the user moves the casing 2 from the first position toward the second position relative to the developing unit 31. Thus, the casing 2 is pivotally moved from the first position toward the second position relative to the developing unit 31. As illustrated in FIGS. 16 and 17, the protrusion 53A is pressed by the gear part 24A while the first protrusion 26A of the toner cartridge 1 contacts the protrusion 58 of the locking member 52A. Similarly, the protrusion 53B is pressed by the gear part 24B while the first protrusion 26B of the toner cartridge 1 contacts the protrusion 58 of the locking member 52B. With this configuration, the developing shutter 51 is moved from the closed position toward the open position while the protrusions 59 are positioned out of the recess 55.

In a case where the casing 2 is further pivotally moved from the first position toward the second position relative the developing unit 31, the developing shutter 51 is further moved from the closed position toward the open position. The protrusion 57 passes by the side of the protrusion 59 opposite to the toner-accommodating section 33.

Figure 19:
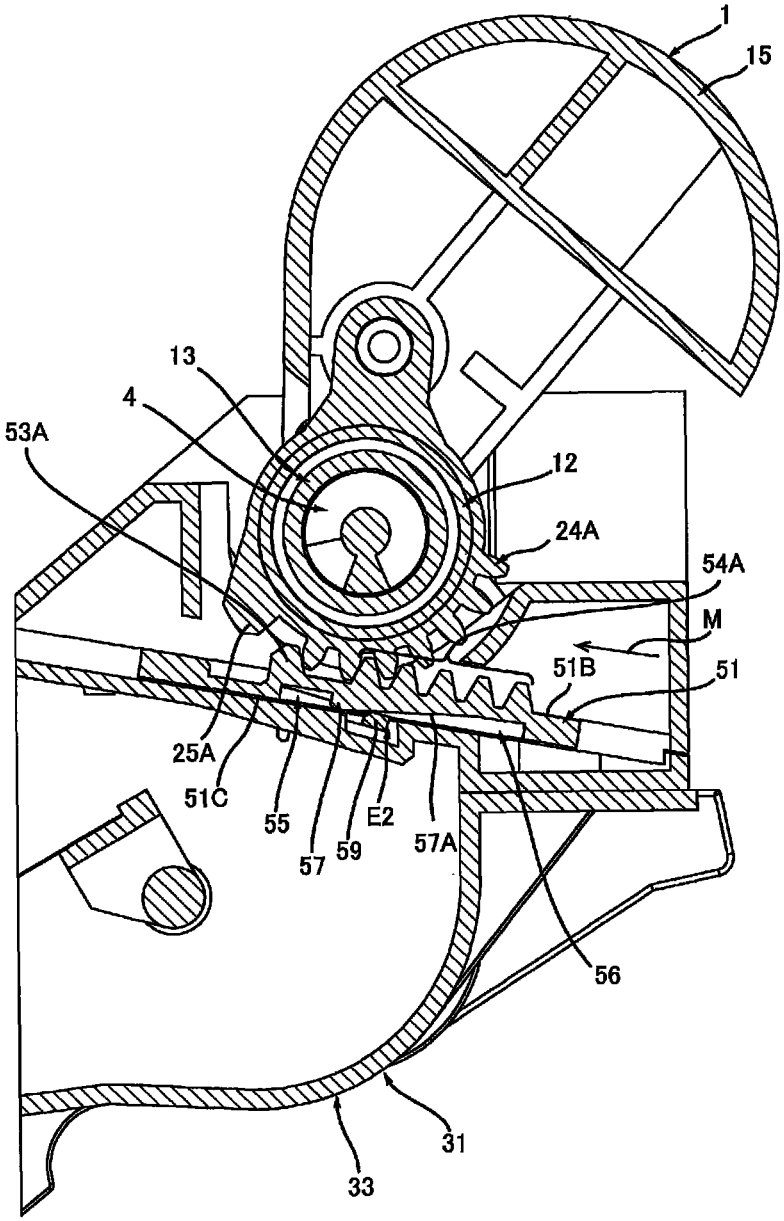
FIG. 19 is a cross-sectional view of the developing unit 31 and the toner cartridge 1 illustrated in FIG. 18 in which a cross section of the gear part 54A of the developing shutter 51 appears, and illustrating a state where a protrusion 59 of the locking member 52A contacts a protrusion 57 of the developing shutter 51 and the gear part 24A of the toner cartridge 1 is meshed with the gear part 54A of the developing shutter 51.
Figure 20:
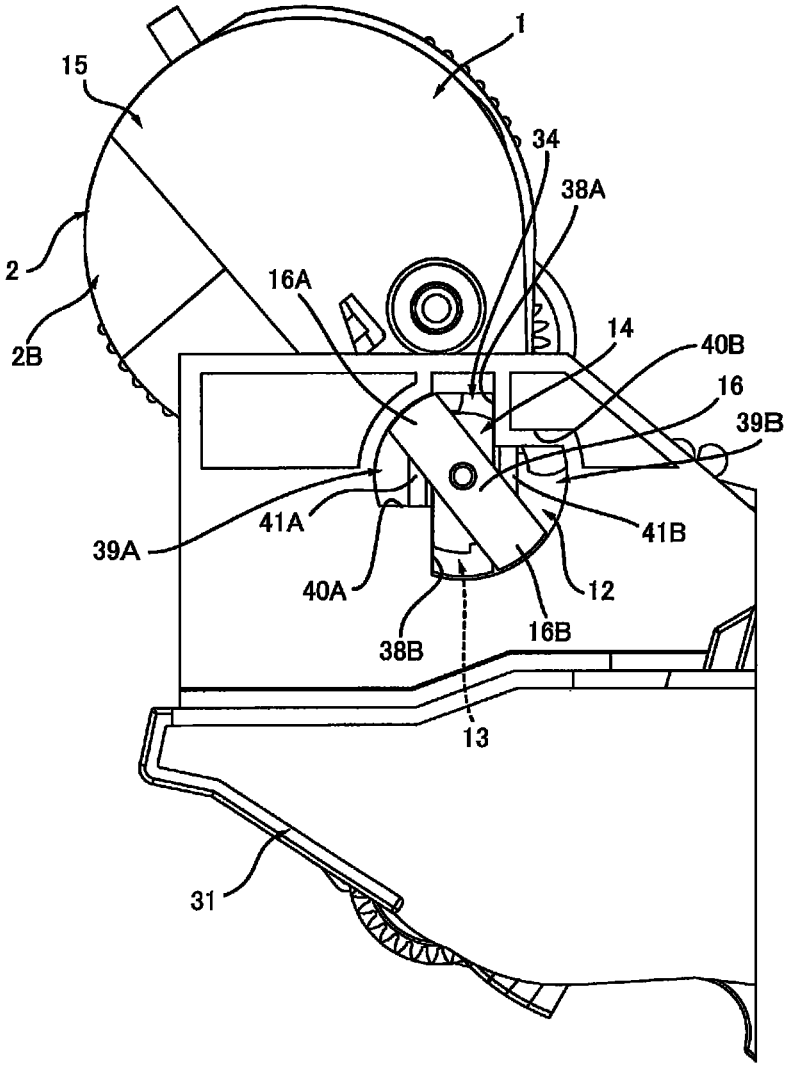
FIG. 20 is a side view of the developing unit 31 and the toner cartridge 1 illustrated in FIG. 18.

Then, as illustrated in FIG. 18, the first protrusion 26A of the toner cartridge 1 separates from the protrusion 58 of the locking member 52A. Similarly, the first protrusion 26B of the toner cartridge 1 separates from the protrusion 58 of the locking member 52B. As a result, the locking member 52A and the locking member 52B are restored from the curved state, and the free end portions E2 of the locking member 52A and the locking member 52B approach the developing shutter 51. Then, as illustrated in FIG. 19, the protrusion 59 of the locking member 52A contacts the sloped surface 57A of the protrusion 57, and the plurality of gear teeth of the gear part 24A is meshed with the plurality of gear teeth of the gear part 54A. The protrusion 59 of the locking member 52B contacts the sloped surface 57A of the protrusion 57, and the plurality of gear teeth of the gear part 24B is meshed with the plurality of gear teeth of the gear part 54B. In other words, in a case where the toner cartridge 1 is pivotally movable relative to the developing unit 31, each of at least one of the plurality of gear teeth of the gear part 24A and the gear part 24B are engaged with the developing shutter 51 for opening and closing the opening 36 formed at the developing unit 31. With this configuration, as the casing 2 is pivotally moved from the first position to the second position, the plurality of gear teeth of the gear part 24A and the gear part 24B move the developing shutter 51 from the closed position to the open position. Further, as illustrated in FIG. 20, the first frame 16A of the cover part 16 is fitted into the recess 39A of the groove 34, and the second frame 16B of the cover part 16 is fitted into the recess 39B of the groove 34.

Figure 21:
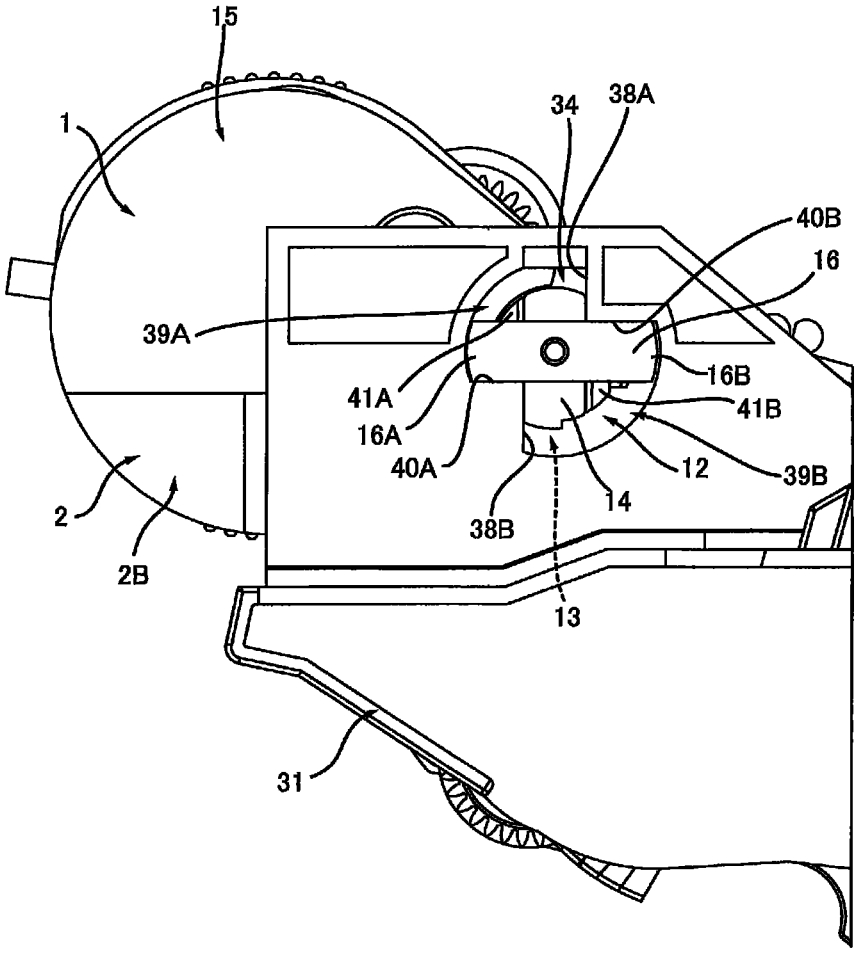
FIG. 21 is a side view of the developing unit 31 and the toner cartridge 1 and illustrating the second position of the casing 2.
Figure 22:
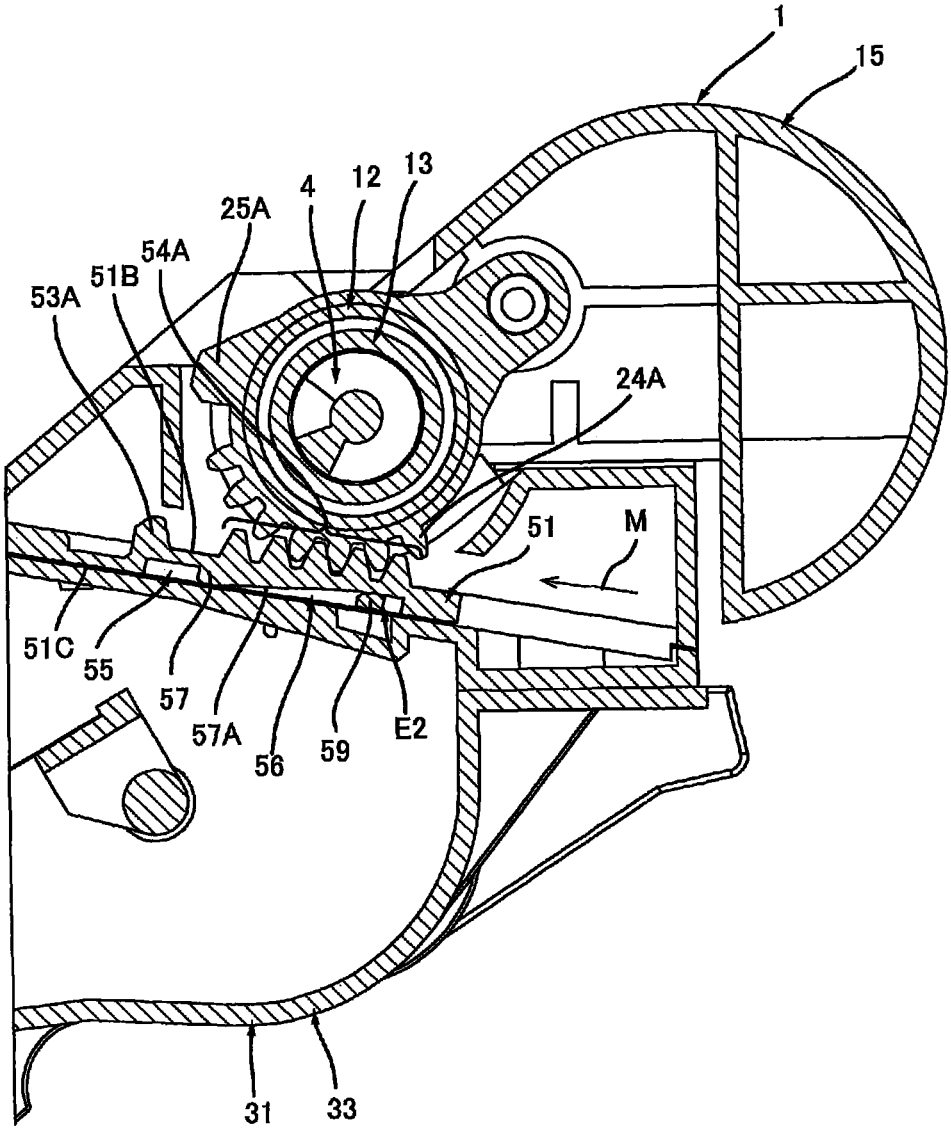
FIG. 22 is a cross-sectional view of the developing unit 31 and the toner cartridge 1 illustrated in FIG. 21 in which a cross section of the gear part 54A of the developing shutter 51 appears, and illustrating a state where the protrusion 59 of the locking member 52A is positioned inside a recess 56 of the developing shutter 51.

Next, as illustrated in FIG. 21, at least one of the first frame 16A and the second frame 16B of the cover part 16 contacts the corresponding flat surface 40A and the flat surface 40B of the groove 34, and the casing 2 is positioned at the second position relative to the shutter 13. At this time, as illustrated in FIG. 22, the developing shutter 51 is positioned at the open position and the protrusions 59 are fitted into the recess 56. Also at this time, as illustrated in FIG. 23, the shutter 13 is at the open position relative to the casing 2, and at least the portion of the third opening 13D overlaps at least the portion of the second opening 12A. Consequently, the third opening 13D allows toner to be discharged through the second opening 12A. In this way, the attachment of the toner cartridge 1 to the developing unit 31 is completed.

4.2 Detachment of Toner Cartridge 1 from Developing Unit 31

When toner cartridge 1 is detached from the developing unit 31, the user moves the casing 2 from the second position illustrated in FIG. 21 toward the first position illustrated in FIG. 11 relative to the developing unit 31.

As illustrated in FIG. 19, the gear part 24A of the toner cartridge 1 is meshed with the gear part 54A. The gear part 24B of the toner cartridge 1 is meshed with the gear part 54B. Thus, the developing shutter 51 starts moving from the open position toward the closed position. At this time, the protrusions 59 are moved along the sloped surface 57A of the protrusion 57 in a direction away from the developing shutter 51 in the second direction.

As the casing 2 is further pivotally moved toward the first position, as illustrated in FIG. 16, the first protrusion 26A of the toner cartridge 1 contacts and urges the protrusion 58 of the locking member 52A. The first protrusion 26B of the toner cartridge 1 contacts and urges the protrusion 58 of the locking member 52B. Further, as illustrated in FIG. 17, the gear part 24A of the toner cartridge 1 separates from the gear part 54A. Similarly, the gear part 24B of the toner cartridge 1 separates from the gear part 54B. As a result, the developing shutter 51 temporarily stops moving.

Next, as the casing 2 further continues to be pivotally moved toward the first position, the second protrusion 25A of the toner cartridge 1 contacts the protrusion 53A of the developing shutter 51. Similarly, the second protrusion 25B of the toner cartridge 1 contacts the protrusion 53B of the developing shutter 51. As each of the protrusion 53A and the protrusion 53B of the developing shutter 51 is pressed by corresponding each of the second protrusion 25A and the second protrusion 25B of the toner cartridge 1, the developing shutter 51 is further moved to the closed position.

Next, as illustrated in FIG. 11, in a case where at least one of the first frame 16A and the second frame 16B of the cover part 16 contacts the corresponding flat surface 38A and flat surface 38B of the groove 34, the casing 2 is positioned at the first position. At this time, as illustrated in FIG. 15, the developing shutter 51 is positioned at the closed position. Also at this time, as illustrated in FIG. 13, the shutter 13 is at the closed position relative to the cover 12, and the second opening 12A is closed. Next, as illustrated in FIG. 10, the user pulls the toner cartridge 1 out of the developing unit 31 in the second direction (the direction opposite to the mounting direction). In this way, the detachment of the toner cartridge 1 from the developing unit 31 is completed.

5. Conveyance of Toner from Toner Cartridge 1 to Developing Unit 31

In the state where the toner cartridge 1 is attached to the developing unit 31 and the casing 2 is positioned at the second position, the gear 23 (see FIG. 1) of the toner cartridge 1 is meshed with a gear 30 (see FIG. 7) of the developing unit 31.

Then, in a case where the image forming apparatus executes an image forming operation, a driving force is inputted front the gear 30 of the developing unit 31 to the gear 23 of the toner cartridge 1. Through this operation, the toner conveyance unit 4 rotates. The driving force is also inputted from the gear 23 to the agitator 3 through a gear train (not shown), and the agitator 3 rotates. Accordingly, agitator 3 conveys toner in the second internal space 2E to the first internal space 2D.

Next, as illustrated in FIG. 4, toner in the first internal space 2D is conveyed from the first internal space 2D to the internal space of the shutter 13 by the toner conveyance unit 4. Through this operation, as illustrated in FIG. 23, the third opening 13D overlaps the second opening 12A to form an opening, and the opening 51A of the developing shutter 51 overlaps the opening 36 to form another opening. Then, toner in the internal space of the shutter 13 is supplied into the toner-accommodating section 33 of the developing unit 31 through the formed openings.

6. Function and Effect

As illustrated in FIG. 14, in a case where the toner cartridge 1 is attached to the developing unit 31 by the user, the first protrusion 26A of the toner cartridge 1 contacts the protrusion 58 of the locking member 52A. Similarly, the first protrusion 26B of the toner cartridge 1 contacts the protrusion 58 of the locking member 52B. With this configuration, both of the locking member 52A and the locking member 52B are curved so that the free end portions E2 separate from the developing shutter 51. At this time, as illustrated in FIG. 15, the protrusion 59 of the locking member 52A is positioned out of the recess 55 of the developing shutter 51. Similarly, the protrusion 59 of the locking member 52B is positioned out of the recess 55 of the developing shutter 51. In this way, the first protrusion 26A and the first protrusion 26B release the developing shutter 51 from the locking member 52A and the locking member 52B, respectively.

Consequently, according to the user's operation for attachment of the toner cartridge 1 to the developing unit 31, the locking member 52A and the locking member 52B of the developing unit 31 are moved from the locking position to the released position to allow the developing shutter 51 to move.

Then, as illustrated in FIGS. 17, 19, and 22, pluralities of gear teeth of gear part 24A and gear part 24B move the developing shutter 51 from the closed position to the open position. With this configuration, the opening 36 of the developing unit 31 is opened.

While the description has been made in detail with reference to the embodiment(s) thereof, it would be apparent to those skilled in the art that many modifications and variations may be made therein without departing from the spirit of the disclosure.

What is claimed is:

1. A toner cartridge comprising:

a casing extending in a first direction and including a first toner-accommodating section having a first internal space configured to accommodating toner therein, the first toner-accommodating section including one end portion and another end portion in the first direction, the first toner-accommodating section having a first opening positioned at the one end portion, the first opening allowing toner in the first internal space to be discharged therethrough;

a toner conveyance unit extending in the first direction and rotatable in a rotating direction about a first axis extending in the first direction, the toner conveyance unit being configured to convey toner from the first internal space to the first opening;

a cover positioned at the one end portion of the first toner-accommodating section and covering the first opening, the cover having a second opening allowing toner in the first internal space to be discharged therethrough, the cover including a plurality of gear teeth positioned at a circumferential surface of the cover, the plurality of gear teeth being arrayed in the rotating direction, the plurality of gear teeth being positioned at one side of the second opening in the first direction and being configured to move a developing shutter of a developing unit for opening or closing an opening of the developing unit; and a first protrusion positioned opposite to the second opening with respect to the plurality of gear teeth in the first direction, the first protrusion being configured to release the developing shutter from a locking member of the developing unit, the locking member being configured to lock the developing shutter.

2. The toner cartridge according to claim 1, wherein the toner cartridge is attachable to the developing unit, wherein the casing is pivotally movable between a first position and a second position together with the cover relative to the toner conveyance unit in a state where the toner cartridge is attached to the developing unit, and wherein the plurality of gear teeth moves the developing shutter of the developing unit from a closed position for closing the opening to an open position for opening the opening in a case where the casing is pivotally moved from the first position to the second position.

3. The toner cartridge according to claim 2, further comprising a shutter positioned at the one end of the first toner-accommodating portion and having a third opening, wherein the second opening is closed by the shutter in a case where the casing is positioned at the first position, and wherein at least a portion of the third opening of the shutter allows toner to be discharged through the second opening in a case where the casing is positioned at the second position.

4. The toner cartridge according to claim 3, wherein the shutter comprises a protrusion extending in the first direction, the protrusion being positioned farther from the another end portion of the first toner-accommodating section than the cover from the another end portion of the first toner-accommodating section, the protrusion being subjected to positioning relative to the developing unit in the state where the toner cartridge is attached to the developing unit.

5. The toner cartridge according to claim 1, wherein the plurality of gear teeth is positioned at a portion of the circumferential surface of the cover.

6. The toner cartridge according to claim 1, wherein the cover further comprises another set of plurality of gear teeth arrayed in the rotating direction, the another set being positioned at the circumferential surface of the cover and positioned at another side of the second opening in the first direction.

7. The toner cartridge according to claim 1, wherein the first protrusion is configured to contact the locking member of the developing unit in a case where the toner cartridge is attached to the developing unit.

8. The toner cartridge according to claim 1, wherein the first protrusion has a distal end, each of the plurality of gear teeth having a distal end, the distal end of the first protrusion being positioned farther from the toner conveyance unit than each of the distal ends of the plurality of gear teeth from the toner conveyance unit.

9. The toner cartridge according to claim 1, wherein the cover further comprises a second protrusion arrayed with the plurality of gear teeth in the rotating direction of the toner conveyance unit, and wherein a gap length between the second protrusion and a gear tooth closest to the second protrusion among the plurality of gear teeth in the rotating direction of the toner conveyance unit is greater than an interval between neighboring gear teeth in the rotating direction of the toner conveyance unit.

10. The toner cartridge according to claim 9, wherein the gap length is equal to a pitch length of the plurality of gear teeth.

11. The toner cartridge according to claim 1, wherein the toner conveyance unit has a spiral shape.

12. The toner cartridge according to claim 1, wherein the toner conveyance unit is an auger screw.

13. The toner cartridge according to claim 1, wherein the toner conveyance unit extends to the second opening, the toner conveyance unit including one end portion having a circumferential surface, and wherein the cover extends along the circumferential surface to cover the circumferential surface.

14. The toner cartridge according to claim 1, wherein the casing further comprises:

a second toner-accommodating section positioned at one side of the first toner-accommodating section in a second direction, the second toner-accommodating section having a second internal space, the second internal space being in communication with the first internal space; and an agitator rotatable about a second axis extending in the first direction, the agitator being configured to agitate toner in the second internal space and convey toner from the second internal space to the first internal space, and wherein a length of the second internal space in the first direction is shorter than a length of the first internal space in the first direction.

15. The toner cartridge according to claim 14, wherein the first internal space and the second internal space are aligned in the second direction, the second direction being defined as a direction in which an imaginary line connecting the first axis to the second axis extends.

* * * * *